US008911271B2

(12) United States Patent
Shibayama

(10) Patent No.: US 8,911,271 B2
(45) Date of Patent: Dec. 16, 2014

(54) MARINE VESSEL AND MARINE VESSEL PROPULSION UNIT

(71) Applicant: Yamaha Hatsudoki Kabushiki Kaisha, Iwata-shi, Shizuoka (JP)

(72) Inventor: Susumu Shibayama, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 143 days.

(21) Appl. No.: 13/680,284

(22) Filed: Nov. 19, 2012

(65) Prior Publication Data

US 2013/0137317 A1 May 30, 2013

(30) Foreign Application Priority Data

Nov. 24, 2011 (JP) ..... 2011-256432

(51) Int. Cl.
*B63H 11/04* (2006.01)
*B63H 21/17* (2006.01)
*B63H 11/08* (2006.01)

(52) U.S. Cl.
CPC ..... *B63H 11/04* (2013.01); *B63H 21/17* (2013.01); *B63H 11/08* (2013.01); *B63H 2011/081* (2013.01)
USPC ..... 440/6; 440/38

(58) Field of Classification Search
USPC ..... 440/6, 38; 114/55.5, 55.57
See application file for complete search history.

(56) References Cited

U.S. PATENT DOCUMENTS 5,490,768 A * 2/1996 Veronesi et al. ..... 440/38
7,226,324 B2 * 6/2007 Roos ..... 440/6
2004/0166746 A1 * 8/2004 Krietzman ..... 440/6

FOREIGN PATENT DOCUMENTS

JP 2002-362488 A 12/2002

* cited by examiner

*Primary Examiner* — Lars A Olson
(74) *Attorney, Agent, or Firm* — Keating & Bennett, LLP

(57) ABSTRACT

A marine vessel includes a hull, a jet pump disposed outside the hull, and an electric motor arranged to drive the jet pump. The jet pump includes a water inlet, a jet nozzle disposed posterior to the water inlet, and a flow path connecting the water inlet and the jet nozzle, and is arranged to jet water, taken in through the water inlet, through the jet nozzle. The electric motor is disposed between the hull and the jet pump.

25 Claims, 16 Drawing Sheets

MARINE VESSEL AND MARINE VESSEL PROPULSION UNIT

BACKGROUND OF THE INVENTION

1. Field of the Invention

The present invention relates to a marine vessel including a jet pump and to an electric marine vessel propulsion unit including a jet pump.

2. Description of the Related Art

Jet propulsion marine vessels including a jet pump have been known. Japanese Unexamined Patent Application Publication No. 2002-362488 discloses a first marine vessel and a second marine vessel each including a jet pump and an electric motor to drive a jet pump.

In the first marine vessel, a portion (duct) of the jet pump is integrated with a hull and an electric motor is disposed in the hull. The jet pump and the electric motor are coupled via a drive shaft penetrating the hull.

In the second marine vessel, the electric motor is disposed in a flow path of the jet pump and coupled to an impeller in the flow path. The electric motor is housed in a bearing case that is disposed in the flow path. A portion (duct) of the jet pump is integrated with the hull.

SUMMARY OF THE INVENTION

The inventor of preferred embodiments of the present invention described and claimed in the present application conducted an extensive study and research regarding marine vessels including a jet pump, such as the ones described above, and in doing so, discovered and first recognized new unique challenges and previously unrecognized possibilities for improvements as described in greater detail below.

That is, in the first marine vessel above, the electric motor is disposed in the hull, which requires work to couple the electric motor and the drive shaft to be performed on the marine vessel. Further, a through-hole is provided in the hull through which the drive shaft is inserted, which requires reliable sealing between the inner peripheral surface of the through-hole and the drive shaft to prevent entry of water into the marine vessel.

In the second marine vessel above, on the other hand, the electric motor is disposed inside the jet pump and no through-hole is provided in the hull, which requires no sealing for such a through-hole. However, since the electric motor is disposed inside the jet pump, the size of the electric motor is limited by the jet pump. This may make it impossible to use a high-power (i.e., large-sized) motor.

In order to overcome the previously unrecognized and unsolved challenges described above, one preferred embodiment of the present invention provides a marine vessel including a hull, a jet pump, and an electric motor. The jet pump is disposed outside the hull. The electric motor is disposed between the hull and the jet pump and is arranged to drive the jet pump. The jet pump includes a water inlet, a jet nozzle disposed posterior to the water inlet, and a flow path connecting the water inlet and the jet nozzle. The jet pump is arranged to jet water, taken in through the water inlet, through the jet nozzle. The marine vessel may be an electric one using an electric motor as a power source or may be a hybrid one using an engine (internal combustion engine) and an electric motor concurrently as a power source.

According to this arrangement, the jet pump is disposed outside the hull and the electric motor is disposed between the hull and the jet pump. There is thus no need to couple the jet pump and the electric motor using a shaft penetrating the hull.

There is accordingly no need to provide a through-hole in the hull through which the shaft is inserted. This can prevent entry of water into the marine vessel. Further, the electric motor, which is disposed between the hull and the jet pump, may be larger as compared to the case where the electric motor is disposed inside the jet pump. This can increase the maximum output of the jet pump.

In one preferred embodiment of the present invention, the electric motor may be attached to either the hull or the jet pump or may be attached to both the hull and the jet pump. If the electric motor is attached to the jet pump, the electric motor may be attached directly to the jet pump or may be attached to the jet pump via an intermediate member. Similarly, if the electric motor is attached to the hull, the electric motor may be attached directly to the hull or may be attached to the hull via an intermediate member. If the electric motor is attached to the jet pump, the jet pump may include a motor attachment portion to which the electric motor is attached. In this case, the electric motor may be attached directly to the motor attachment portion or may be attached to the motor attachment portion via a spacer.

In one preferred embodiment of the present invention, the jet pump may include a duct that defines at least a portion of the flow path. In this case, the motor attachment portion may be disposed anterior to the duct. That is, the electric motor may be attached to the jet pump anterior to the duct.

In one preferred embodiment of the present invention, the motor attachment portion may be integrated with or separate from the duct. If the motor attachment portion is integrated with the duct, the strength of the coupling between the motor attachment portion and the duct can be increased and the number of parts can be reduced.

In one preferred embodiment of the present invention, the motor attachment portion may be disposed posterior to the front end of the water inlet. In this case, the motor attachment portion may be arranged above the water inlet and the electric motor may be at least partially arranged above the water inlet.

In one preferred embodiment of the present invention, the jet pump and the electric motor may be installed separately or together in the hull. That is, the jet pump and the electric motor may be unitized so as to be installed in the hull with the electric motor being attached to the motor attachment portion. In this case, since the electric motor is attached to the jet pump, attaching the jet pump to the hull results in the electric motor being attached to the hull. This can reduce the burden of attaching the electric motor to the hull.

In one preferred embodiment of the present invention, the marine vessel may further include a motor cooling device that cools the electric motor. The motor cooling device may be of a water-cooled type or another type including an air-cooled type. If the motor cooling device is of a water-cooled type, the device may cool the electric motor with water supplied from the flow path.

Specifically, the motor cooling device may include a cooling water pipe extending from the flow path to the electric motor outside the hull and arranged to cool the electric motor with water supplied from the flow path into the cooling water pipe. In this case, the cooling water pipe may extend from a portion of the flow path downstream from an impeller to the electric motor. Further, the motor cooling device may include a water jacket that is attached to the electric motor and is connected to the cooling water pipe. The motor cooling device may also include a discharge portion that discharges water supplied from the flow path into the cooling water pipe toward the electric motor. That is, the motor cooling device may discharge water guided through the cooling water pipe toward the electric motor through the discharge portion.

In one preferred embodiment of the present invention, the marine vessel may further include a motor controller arranged and programmed to control the electric motor and a battery arranged to supply power to the motor controller. The marine vessel may further include a power supply wire connecting the motor controller and the electric motor. The motor controller and the battery may be disposed in the hull. In this case, the power supply wire may extend from inside to outside the hull through a first through-hole provided in the hull. The marine vessel may further include a first seal providing a tight seal between the inner peripheral surface of the first through-hole and the power supply wire. According to this arrangement, the first seal can prevent entry of water into the marine vessel. Specifically, compared to rotary members such as drive shafts, the power supply wire has a smaller outside diameter and hardly moves with respect to the hull. This allows for reliable sealing between the inner peripheral surface of the first through-hole and the power supply wire, and thereby can prevent entry of water into the marine vessel.

In one preferred embodiment of the present invention, the marine vessel may further include a battery, an operation unit arranged to be operated by a vessel operator, and a motor controller arranged and programmed to control the electric motor. The marine vessel may further include a power supply wire connecting the motor controller and the battery and a control wire connecting the operation unit and the motor controller. The control wire is used to transmit a control signal between the operation unit and the motor controller. The battery and the operation unit may be disposed in the hull. The motor controller may be located in the electric motor. In this case, the power supply wire may extend from inside to outside the hull through a first through-hole provided in the hull. Further, the control wire may extend from inside to outside the hull through a second through-hole provided in the hull. The marine vessel may further include a first seal providing a tight seal between the inner peripheral surface of the first through-hole and the power supply wire, and a second seal providing a tight seal between the inner peripheral surface of the second through-hole and the control wire. According to this arrangement, the first and second seals can reliably prevent entry of water into the marine vessel.

In one preferred embodiment of the present invention, the marine vessel may further include a battery, an operation unit arranged to be operated by a vessel operator, and a motor controller arranged and programmed to control the electric motor. The marine vessel may further include a power supply wire connecting the motor controller and the battery and a control wire connecting the operation unit and the motor controller. The battery and the operation unit may be disposed in the hull. The motor controller may be located in the electric motor. In this case, the power supply wire and the control wire may extend from inside to outside the hull through a common through-hole provided in the hull. The marine vessel may further include a common seal providing a tight seal between the inner peripheral surface of the common through-hole and the power supply wire as well as between the inner peripheral surface of the common through-hole and the control wire. According to this arrangement, entry of water into the marine vessel can be prevented reliably, and the number of parts can be reduced.

In one preferred embodiment of the present invention, the motor controller may not be provided between the battery and the electric motor, and the output torque of the electric motor may not be controlled. Specifically, the marine vessel may further include a battery and a power supply wire connecting the battery and the electric motor. The battery may be disposed in the hull. In this case, the power supply wire may extend from inside to outside the hull through a first through-hole provided in the hull. The marine vessel may further include a first seal providing a tight seal between the inner peripheral surface of the first through-hole and the power supply wire.

Another preferred embodiment of the present invention provides a marine vessel propulsion unit including a jet pump and an electric motor. The jet pump includes a water inlet, a jet nozzle disposed posterior to the water inlet, and a flow path connecting the water inlet and the jet nozzle. The jet pump includes an impeller disposed in the flow path. The jet pump is arranged to jet water, taken in through the water inlet, through the jet nozzle. The electric motor is disposed outside the flow path and attached to the jet pump. The electric motor is arranged to rotationally drive the impeller. According to this arrangement, the same effects as mentioned above can be exhibited.

In another preferred embodiment of the present invention, the jet pump may include a duct that defines at least a portion of the flow path upstream from the impeller, and a motor attachment portion disposed anterior to the duct. In this case, the electric motor may be attached to the motor attachment portion.

In another preferred embodiment of the present invention, the motor attachment portion may be disposed posterior to the front end of the water inlet. In this case, the motor attachment portion may be arranged above the water inlet, and the electric motor may be at least partially arranged above the water inlet.

In another preferred embodiment of the present invention, the motor attachment portion may be integrated with or separate from the duct.

In another preferred embodiment of the present invention, the jet pump and the electric motor may be unitized so as to be installed in the hull with the electric motor being attached to the motor attachment portion.

In another preferred embodiment of the present invention, the marine vessel propulsion unit may further include a motor cooling device that cools the motor. The motor cooling device may be of a water-cooled type or another type including an air-cooled type. If the motor cooling device is of a water-cooled type, the device may cool the electric motor with water supplied from the flow path.

Specifically, the motor cooling device may include a cooling water pipe extending from the flow path to the electric motor outside the hull and arranged to cool the electric motor with water supplied from the flow path into the cooling water pipe. In this case, the cooling water pipe may extend from a portion of the flow path downstream from the impeller to the electric motor. Further, the motor cooling device may include a water jacket that is attached to the electric motor and is connected to the cooling water pipe. The motor cooling device may also include a discharge portion that discharges water supplied from the flow path into the cooling water pipe toward the electric motor.

In another preferred embodiment of the present invention, the marine vessel propulsion unit may further include a drive shaft that transmits the rotation of the electric motor to the impeller. In this case, the drive shaft may include a front end portion arranged to rotate together with the output shaft of the electric motor and a rear end portion arranged to rotate together with the impeller. Further, the drive shaft may include an intermediate portion that connects the front end portion and the rear end portion and is not in contact with the jet pump.

In one preferred embodiment of the present invention, the electric motor is rotatable in a normal direction and in a reverse direction, in which the rotation of the electric motor in the normal direction causes the impeller to rotate in a normal direction and thereby water to be taken through the water inlet into the flow path to be jetted through the jet nozzle, resulting in a thrust force in a first direction, while the rotation of the electric motor in the reverse direction causes the impeller to rotate in a reverse direction and thereby water to be taken through the jet nozzle into the flow path to be jetted through the water inlet, resulting in a thrust force in a second direction opposite to the first direction. According to this arrangement, switching the rotation direction of the electric motor can result in a thrust force in the opposite direction even with the same impeller.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will hereinafter be described in detail with reference to the accompanying drawings. Each drawing shows a state where a marine vessel remains stationary on the water. In the description below, the "longitudinal direction," "lateral direction (width direction)," and "vertical direction" are based on a hull in a stationary state.

First Preferred Embodiment

Figure 1:
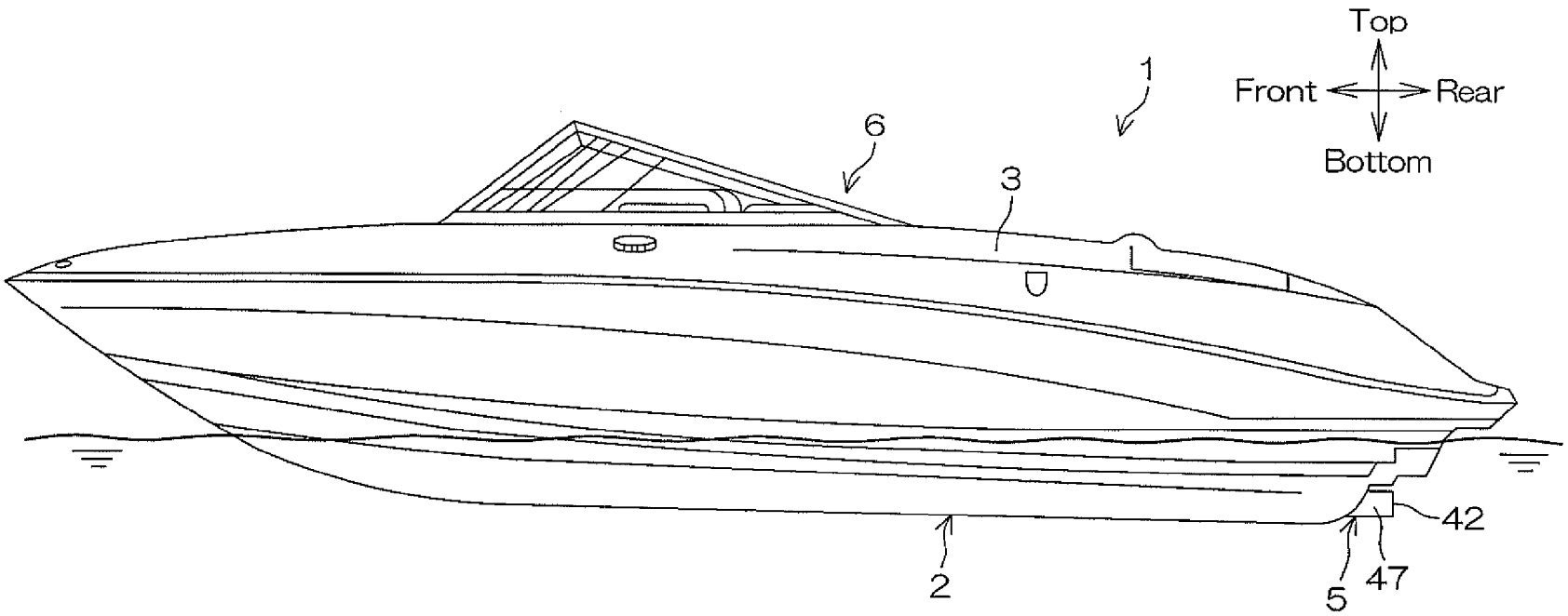
FIG. 1 is a side view of a marine vessel according to a first preferred embodiment of the present invention.
Figure 2:
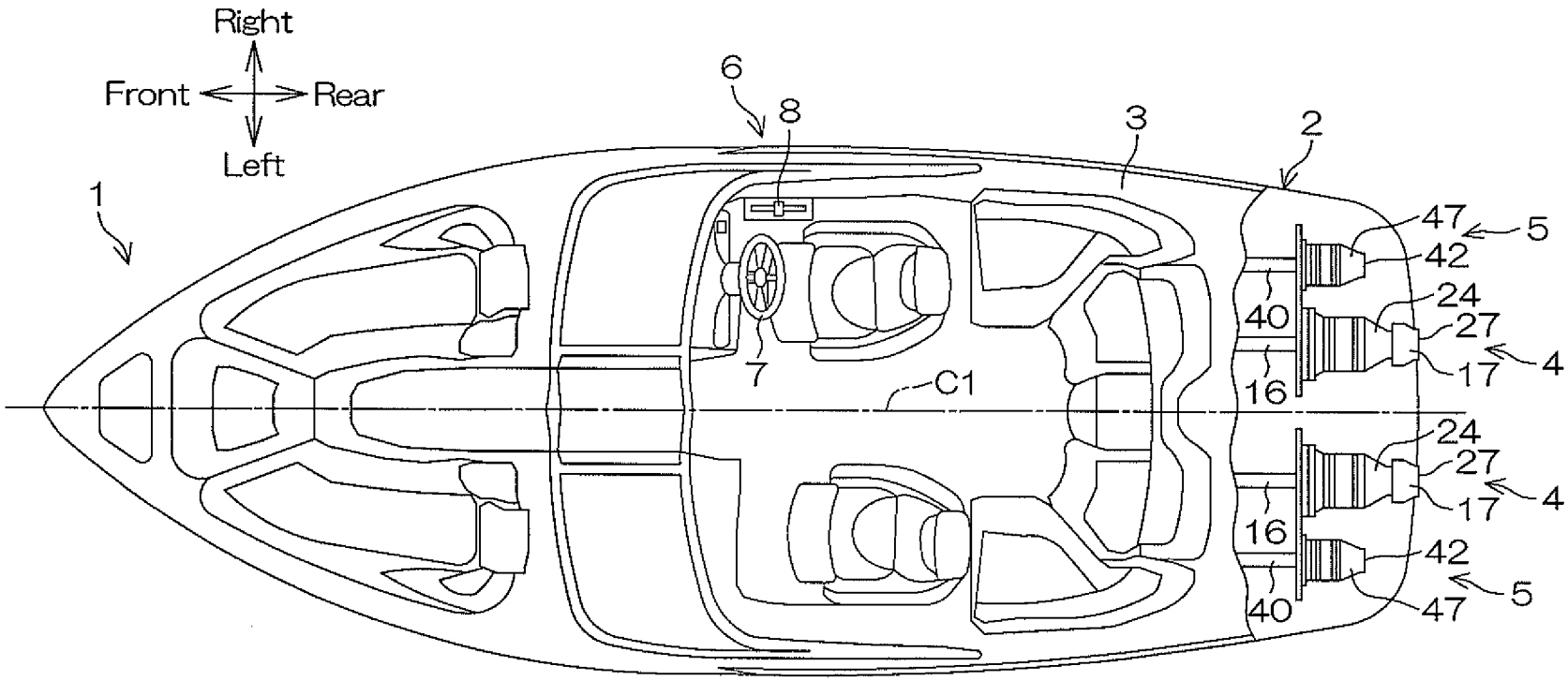
FIG. 2 is a partially broken plan view of the marine vessel according to the first preferred embodiment of the present invention.
Figure 3:
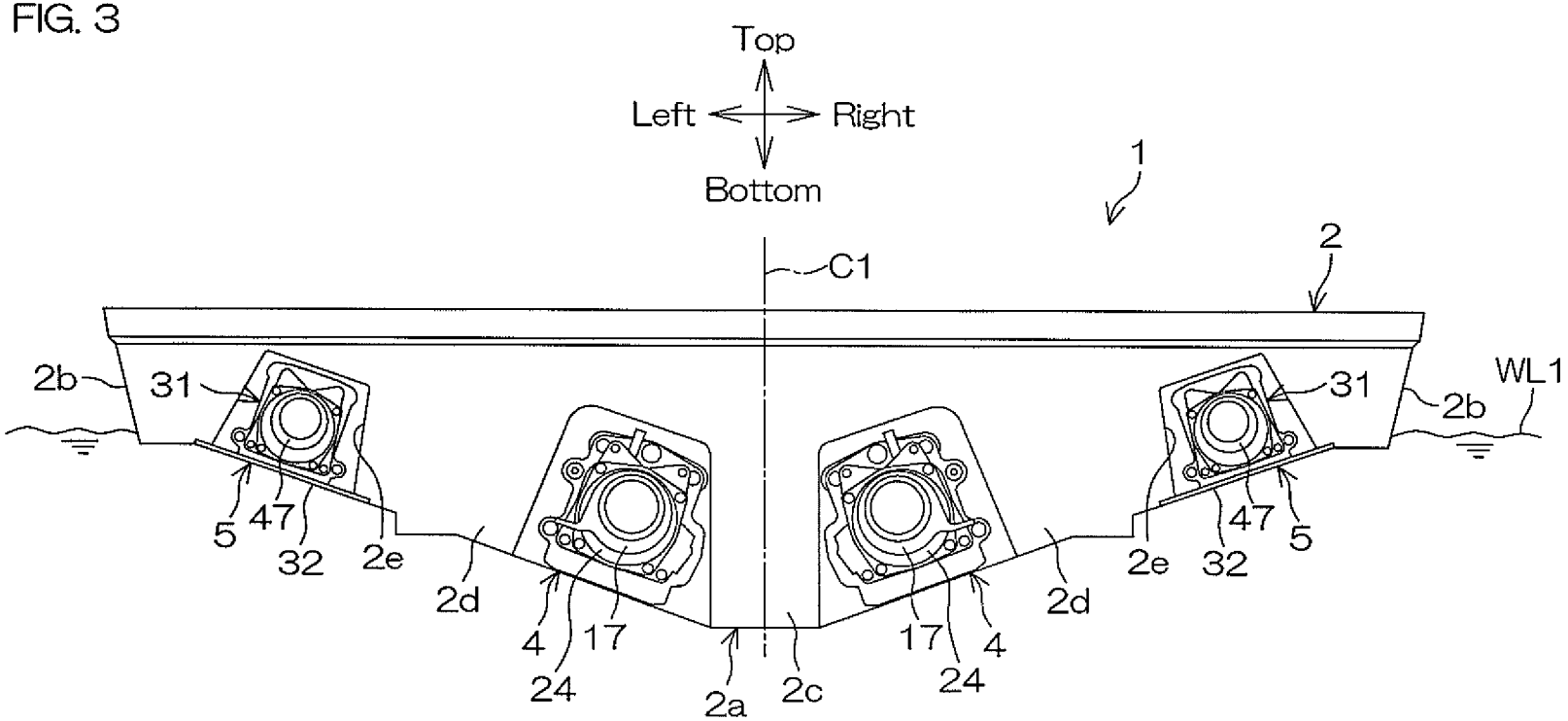
FIG. 3 is a rear view of the marine vessel according to the first preferred embodiment of the present invention.

FIG. 1 is a side view of a marine vessel 1 according to a first preferred embodiment of the present invention. FIG. 2 is a partially broken plan view of the marine vessel 1. FIG. 3 is a rear view of the marine vessel 1.

As shown in FIG. 1, the marine vessel 1 includes a hull 2 and a deck 3 disposed on the hull 2. As shown in FIG. 2, the marine vessel 1 further includes multiple propulsion units 4, 5 arranged to propel the hull 2 and an operation unit 6 to be operated by a vessel operator to steer the marine vessel 1. The operation unit 6 includes a steering wheel 7 arranged to be operated by the vessel operator to steer the marine vessel 1 and an output control lever 8 arranged to be operated by the vessel operator for thrust force control and travel direction switching. The steering wheel 7 and the output control lever 8 are arranged around an operator seat in the deck 3. The multiple propulsion units 4, 5 are attached to a rear portion of the hull 2 and include a pair of first propulsion units 4 that use an engine 10 (see FIG. 4) as a power source and a pair of second propulsion units 5 that use an electric motor 30 (see FIG. 5) as a power source. Both the first and second propulsion units 4, 5 are jet propulsion units and are independent of each other.

As shown in FIG. 2, the pair of first propulsion units 4 are arranged in the central portion in the width direction of the hull 2. Specifically, the first propulsion units 4 each include a first nozzle 24 that jets water rearward from the hull 2. The two first nozzles 24 are arranged laterally symmetrical in the central portion of the hull 2. That is, the two first nozzles 24 are arranged symmetrically with respect to a vertical plane passing through the stem and the stern center (hull center C1). The pair of first propulsion units 4 are thus arranged laterally symmetrical in the central portion of the hull 2. Similarly, the second propulsion units 5 each include a second nozzle 47 that jets water rearward. The two second nozzles 47 are arranged laterally symmetrical on the outer side of the two respective first nozzles 24. The pair of second propulsion units 5 are thus arranged laterally symmetrical on the outer side of the central portion in the width direction of the hull 2.

As shown in FIG. 3, the hull 2 includes a bottom portion 2*a* and a pair of left and right side portions 2*b* extending upward, respectively, from the left and right end portions of the bottom portion 2*a*. The bottom portion 2*a* has, for example, a laterally symmetrical V shape from a rear view. Therefore, the bottom portion 2*a* includes a central portion 2*c* (keel) positioned in the lowermost portion of the hull 2 from a rear view and a pair of left and right slanted portions 2*d* extending from the central portion 2*c* to the side portions 2*b*. The slanted portions 2*d* have a gradient such that the outer end portions (chines) are positioned above the inner end portions. The central portion 2*c* of the bottom portion 2*a* is thus positioned below the outer end portions of the slanted portions 2*d*. When the marine vessel 1 is in a forward planing state, the draft line WL1 is at approximately the same height as the chines. Therefore, in a planing state, the depth to the central portion 2*c* is greater than that to the chines.

As shown in FIG. 3, the first and second propulsion units 4, 5 are arranged in the bottom portion 2*a*. The pair of first propulsion units 4 are arranged on either side of the hull center C1, and the pair of second propulsion units 5 are arranged on the outer side of the pair of first propulsion units 4 and on either side of the hull center C1. Therefore, the distance in the width direction from the hull center C1 to the second propulsion units 5 is longer than the distance in the width direction from the hull center C1 to the first propulsion units 4. Since the bottom portion 2*a* has a V shape in a rear view and the first and second propulsion units 4, 5 are arranged in the bottom portion 2*a*, the longer the distance from the hull center C1 (in the width direction), the higher the nozzles 24, 47 are located. Therefore, the water pressure on the second nozzles 47 is smaller than that on the first nozzles 24.

Figure 4:
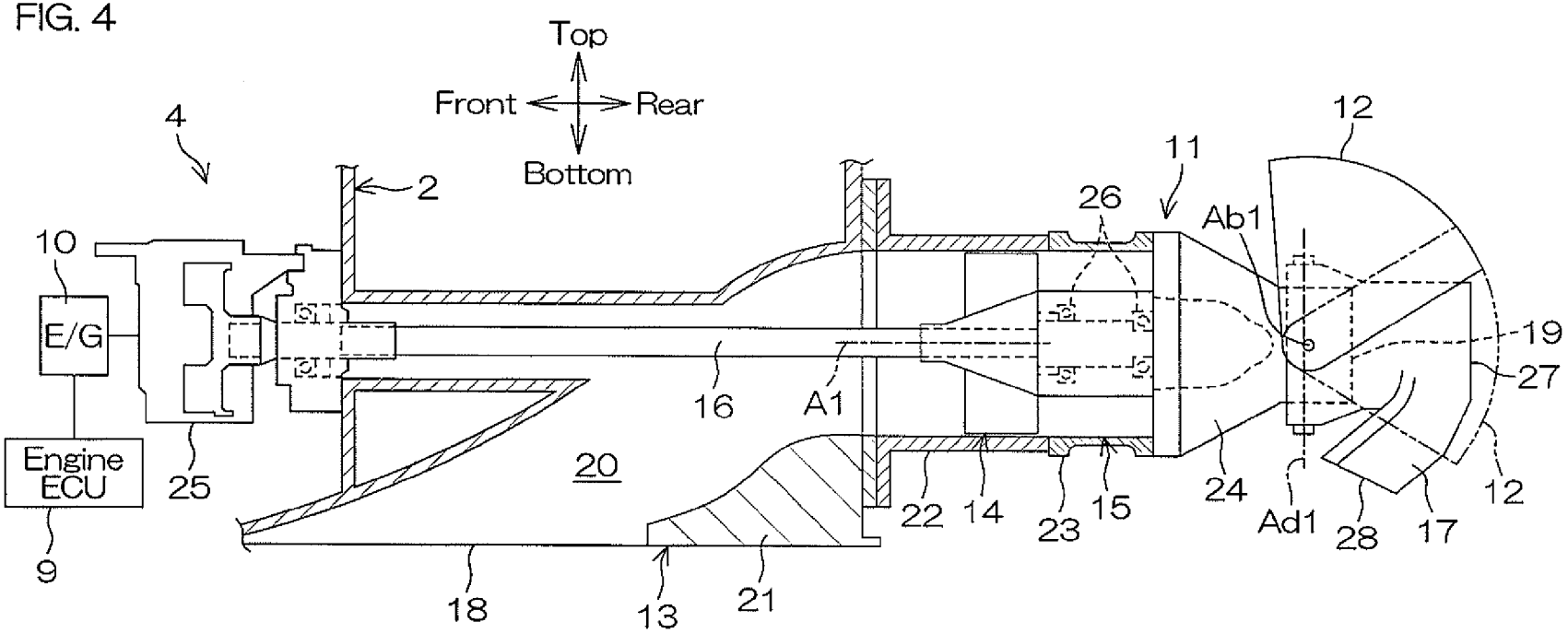
FIG. 4 is a partial sectional view of a first propulsion unit according to the first preferred embodiment of the present invention.

FIG. 4 is a partial sectional view of each first propulsion unit 4 according to the first preferred embodiment of the present invention.

The first propulsion unit 4 includes an engine ECU 9 (Electronic Control Unit), an engine 10, a first jet pump 11, and a first bucket 12. The engine 10 is an internal combustion engine controlled by the engine ECU 9. The engine 10 and the engine ECU 9 are arranged inside the hull 2. The first jet pump 11 is arranged posterior to the engine 10. The first bucket 12 is attached to the rear end portion of the first jet pump 11. The first jet pump 11 is driven by the engine 10 to take in water through the vessel bottom and jet the water rearward. The first bucket 12 can change the direction of water jetted from the first jet pump 11 from rearward to forward.

The first jet pump 11 includes a first defining member 13 including a first flow path 20, a first impeller 14 and a first stator vane 15 arranged in the first flow path 20, and a first drive shaft 16 coupled to the first impeller 14. The first jet pump 11 further includes a first deflector 17 that laterally changes the direction of jet flow and a first screen (not shown) attached to the first defining member 13. The first defining member 13 includes a first water inlet 18 (first inlet) opened downward at the vessel bottom, a first jet nozzle 19 (first outlet) opened rearward posterior to the first water inlet 18, and a first flow path 20 connecting the first water inlet 18 and the first jet nozzle 19. The first defining member 13 includes a first duct 21 defining the first water inlet 18, a cylindrical rotor vane housing 22 surrounding the first impeller 14, a cylindrical stator vane housing 23 surrounding the first stator vane 15, and the first nozzle 24 defining the first jet nozzle 19.

The first drive shaft 16 extends longitudinally. The front end portion of the first drive shaft 16 is coupled to the engine 10 via a coupling 25, while the rear end portion of the first drive shaft 16 is supported rotatably via multiple bearings 26. The first impeller 14 is coupled to the first drive shaft 16 anterior to the rear end portion of the first drive shaft 16. The first stator vane 15 is arranged posterior to the first impeller 14, and the first nozzle 24 is arranged posterior to the first stator vane 15. The first impeller 14 includes multiple blades (rotor vanes) surrounding a first rotational axis A1 (central axis of the first drive shaft 16). Similarly, the first stator vane 15 includes multiple blades surrounding the first rotational axis A1. The first impeller 14 is rotatable about the first rotational axis A1 with respect to the first flow path 20, while the first stator vane 15 is fixed with respect to the first flow path 20.

The first impeller 14 is arranged to be driven about the first rotational axis A1 together with the first drive shaft 16 by the engine 10. When the first impeller 14 is rotationally driven, water is taken through the first water inlet 18 into the first flow path 20 and fed through the first impeller 14 to the first stator vane 15. The flow of water fed through the first impeller 14, though twisted due to the rotation of the first impeller 14, is aligned during passage through the first stator vane 15. Thus, the aligned water is fed from the first stator vane 15 to the first nozzle 24. The first nozzle 24 has a longitudinally extending cylindrical shape. The inside diameter of the rear end portion of the first nozzle 24 is smaller than that of the front end portion of the first nozzle 24. The first jet nozzle 19 includes the rear end portion of the first nozzle 24. Thus, the water fed to the first nozzle 24 is jetted rearward from the rear end portion of the first nozzle 24.

The first deflector 17 is coupled to the first nozzle 24 in a manner laterally rotatable about a vertically extending deflector rotational axis Ad1. The first deflector 17 is hollow. The first jet nozzle 19 is disposed in the first deflector 17. The first deflector 17 defines a forward traveling jet nozzle 27 opened rearward and a backward traveling jet nozzle 28 opened obliquely forward. The forward traveling jet nozzle 27 is arranged posterior to the first jet nozzle 19, and the backward traveling jet nozzle 28 is arranged below the forward traveling jet nozzle 27. The first deflector 17 is laterally rotatable with respect to the first nozzle 24 centering on a straight traveling position. The straight traveling position is a position where water is jetted forward or rearward in a plan view from the first deflector 17. The first deflector 17 is arranged to be rotated laterally about the deflector rotational axis Ad1 when the steering wheel 7 is operated by the vessel operator.

The first bucket 12 is arranged to rotate laterally about the deflector rotational axis Ad1 together with the first deflector 17. The first bucket 12 is coupled to the first deflector 17 in a manner rotatable about a laterally extending bucket rotational axis Ab1. The first bucket 12 is movable between a backward traveling position (indicated by the alternate long and two short dashed lines) and a forward traveling position (indicated by the solid line). The backward traveling position is a position where the forward traveling jet nozzle 27 is covered with the first bucket 12 from a rear view, while the forward traveling position is a position where the forward traveling jet nozzle 27 is not covered with the first bucket 12 from a rear view. The first bucket 12 is arranged to move between the forward traveling position and the backward traveling position when the output control lever 8 is operated by the vessel operator.

When the first bucket 12 is in the forward traveling position, the forward traveling jet nozzle 27 is not covered, resulting in the water jetted from the first jet nozzle 19 passing through the first deflector 17 to be jetted rearward from the forward traveling jet nozzle 27. This causes a thrust force in the forward direction. In this state, when the first deflector 17 is rotated laterally about the deflector rotational axis Ad1, the direction of jet flow of water from the forward traveling jet nozzle 27 is changed laterally. This causes the direction of jet flow of water from the first deflector 17 to be tilted from longitudinal to lateral and thereby the marine vessel 1 to rotate while traveling forward.

On the other hand, when the first bucket 12 is in the backward traveling position, the forward traveling jet nozzle 27 is covered, resulting in the water jetted from the first jet nozzle 19 is not jetted from the forward traveling jet nozzle 27 but jetted forward from the backward traveling jet nozzle 28. This causes a thrust force in the backward direction. In this state, when the first deflector 17 is rotated laterally about the deflector rotational axis Ad1, the direction of jet flow of water from the backward traveling jet nozzle 28 is changed laterally. This causes the direction of jet flow of water from the first deflector 17 to be tilted from longitudinal to lateral and thereby the marine vessel 1 to rotate while traveling backward.

Figure 5:
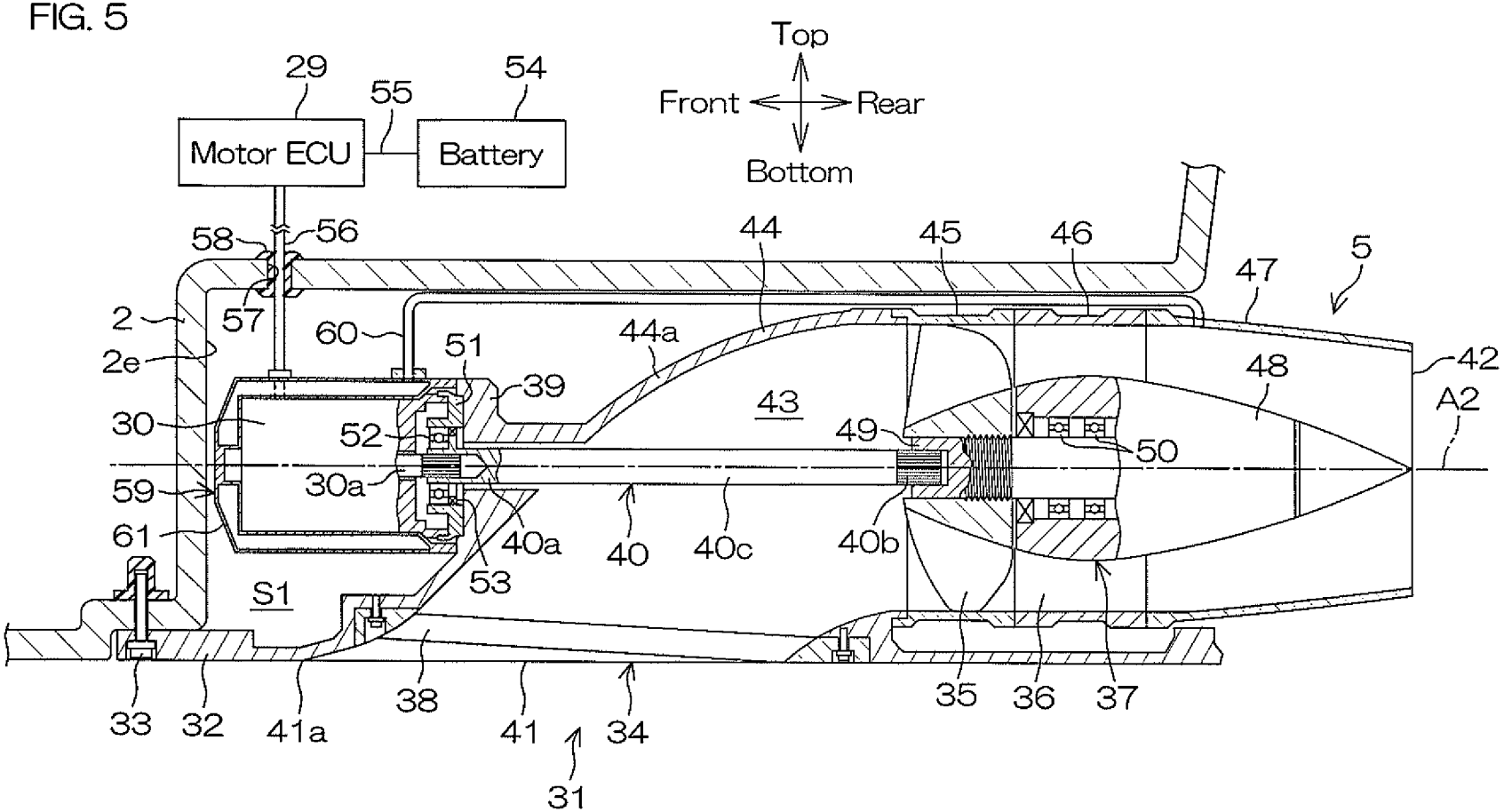
FIG. 5 is a sectional view of a second propulsion unit according to the first preferred embodiment of the present invention.
Figure 6:
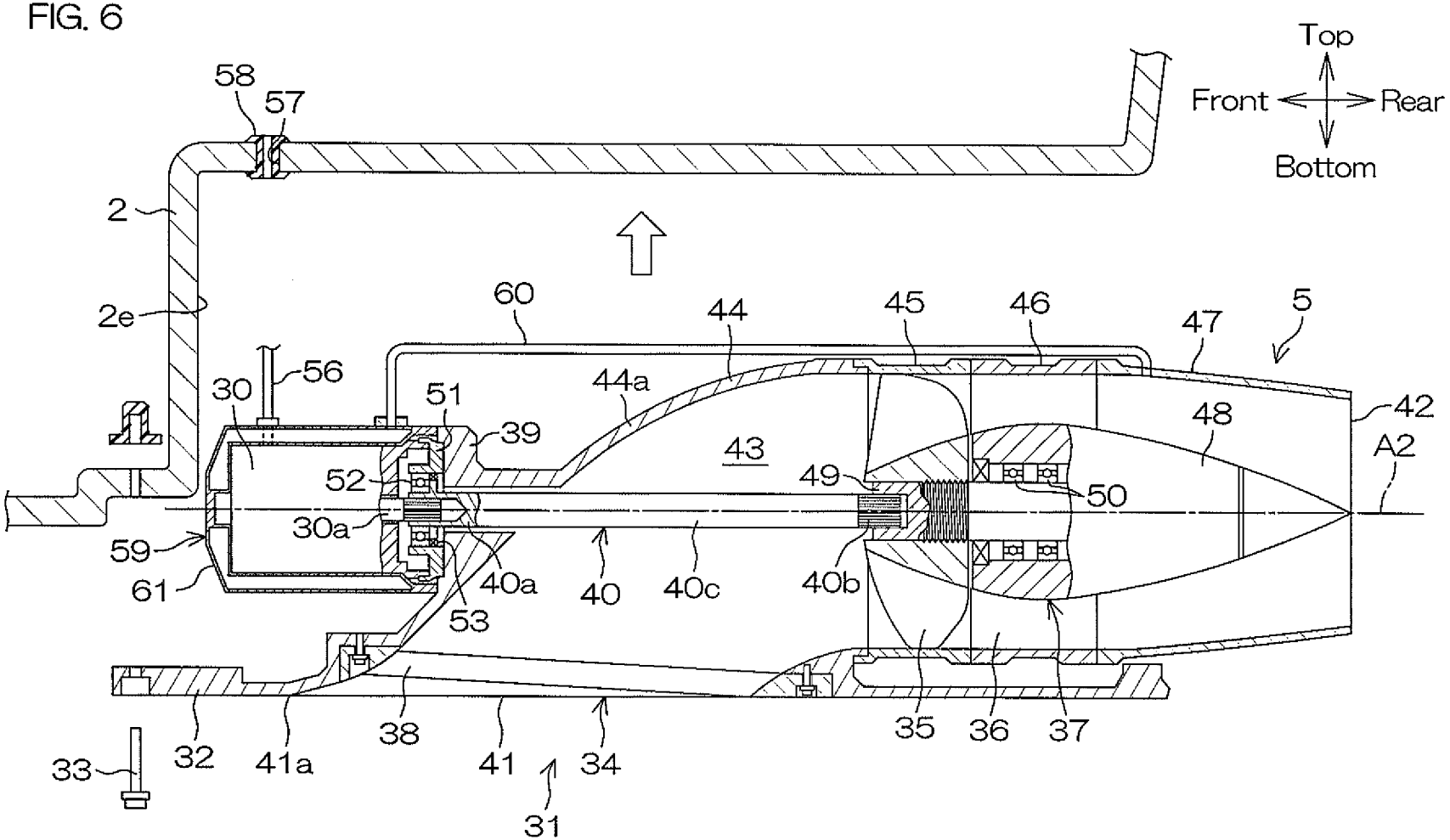
FIG. 6 is a sectional view showing a state before an electric motor and a second jet pump are attached.
Figure 7:
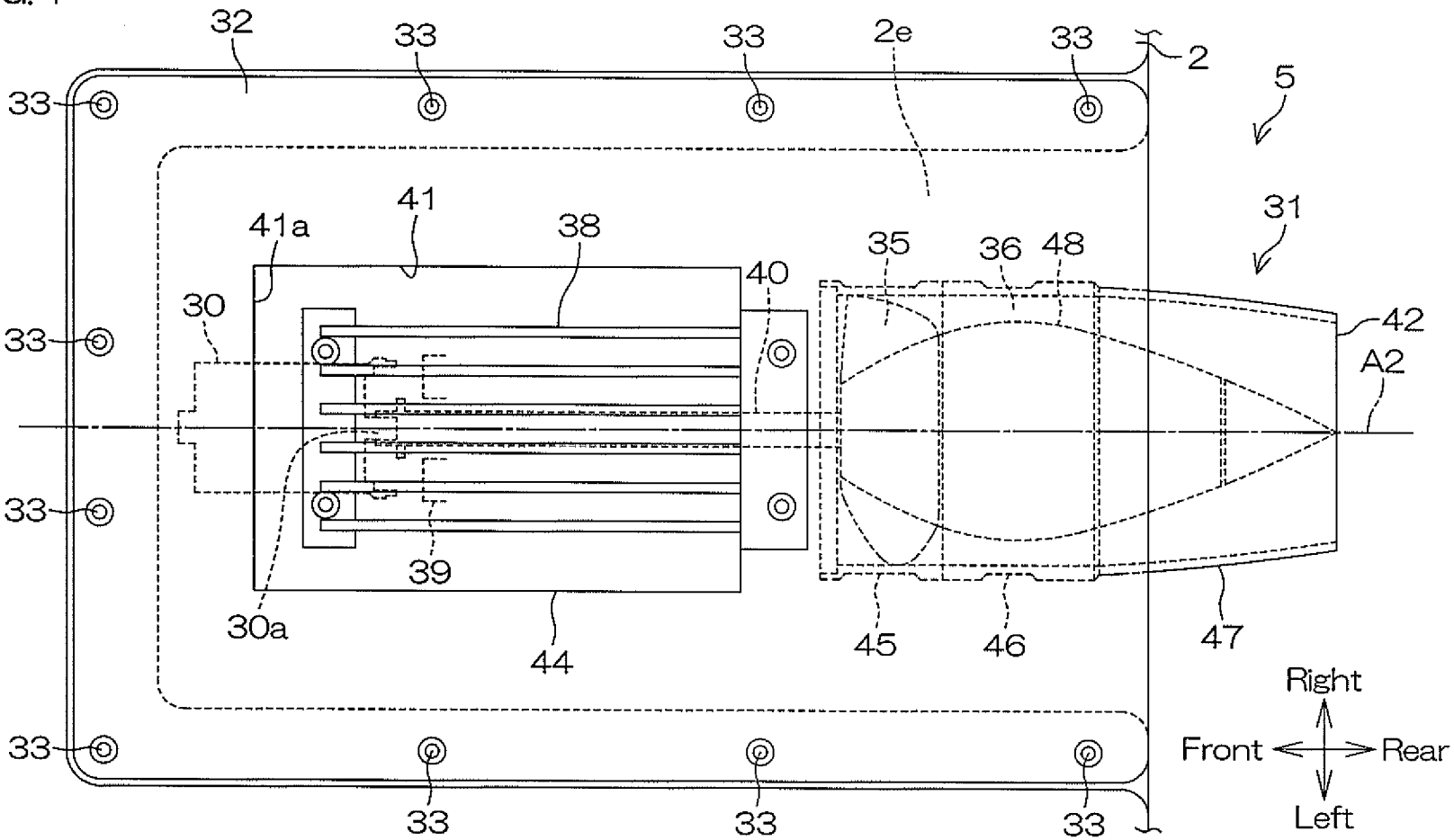
FIG. 7 is a bottom view of the second propulsion unit according to the first preferred embodiment of the present invention.
Figure 8:
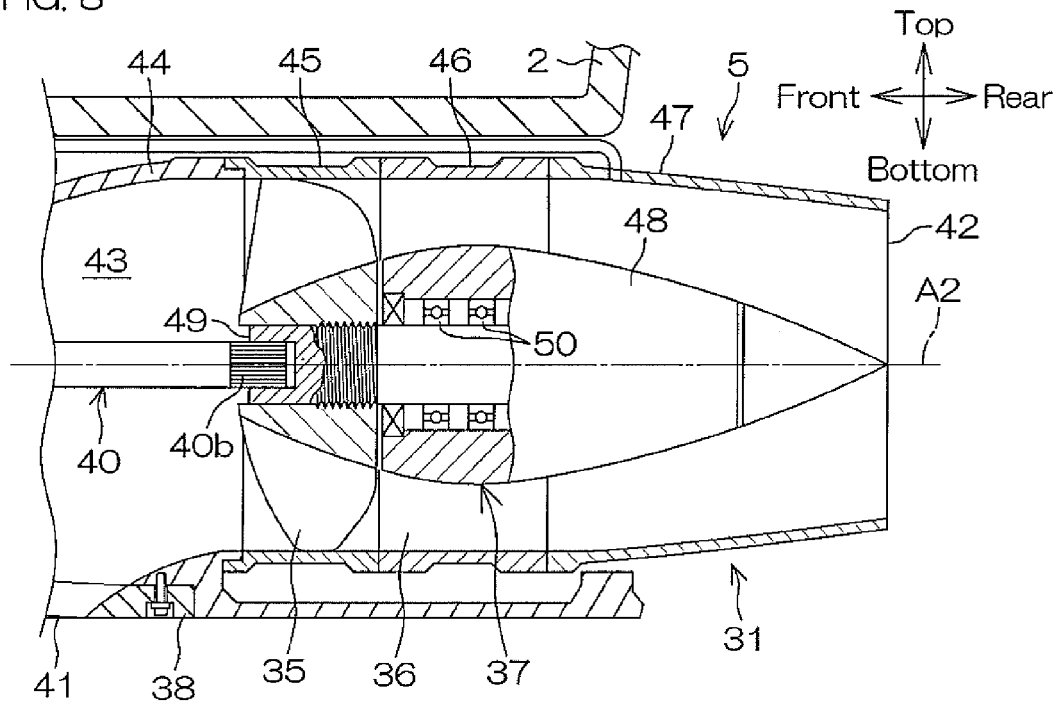
FIG. 8 is a partially enlarged view of FIG. 5, including a second impeller.
Figure 9:
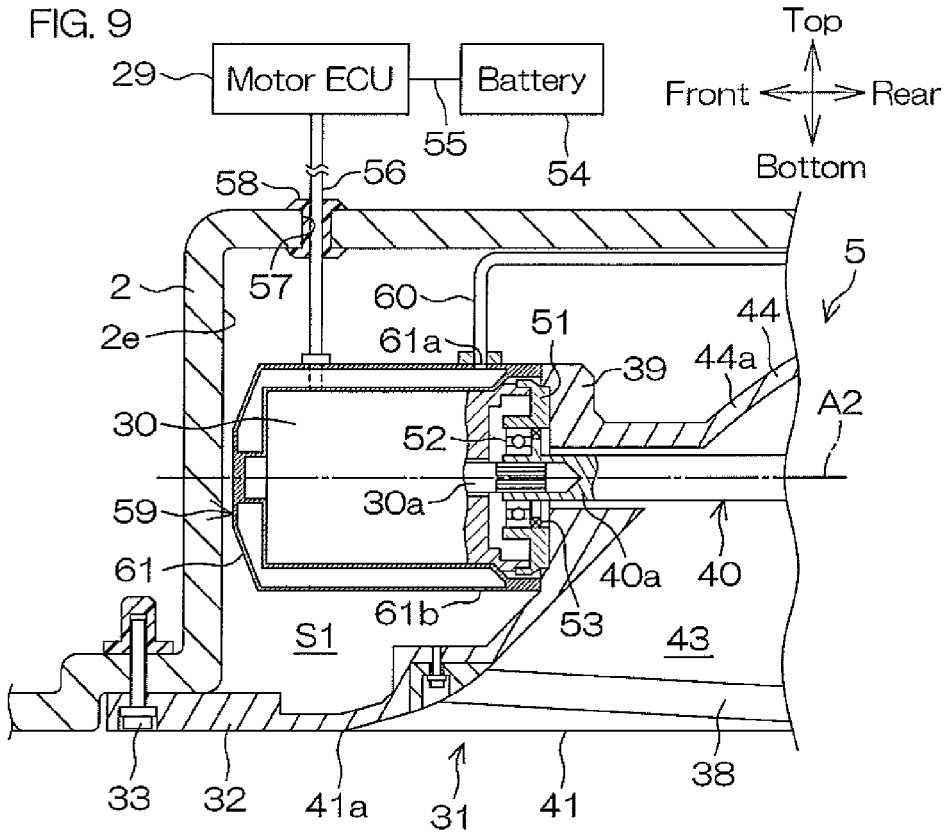
FIG. 9 is a partially enlarged view of FIG. 5, including the electric motor.

FIG. 5 is a sectional view of each second propulsion unit 5 according to the first preferred embodiment of the present invention. FIG. 6 is a sectional view showing a state before the electric motor 30 and a second jet pump 31 are installed in the hull 2. FIG. 7 is a bottom view of the second propulsion unit 5. FIG. 8 is a partially enlarged view of FIG. 5, including a second impeller 35. FIG. 9 is a partially enlarged view of FIG. 5, including the electric motor 30.

As shown in FIG. 5, the second propulsion unit 5 includes a motor ECU 29, the electric motor 30, and the second jet pump 31. The electric motor 30 is, for example, a brushless motor controlled by the motor ECU 29. The second jet pump 31 is arranged outside the hull 2, while the electric motor 30 is arranged between the second jet pump 31 and the hull 2. The electric motor 30 and the second jet pump 31 are housed in a housing portion 2*e* (recessed portion) defined in the hull 2. The housing portion 2*e* is recessed upward from the vessel bottom (see FIGS. 3 and 5). The second propulsion unit 5 is independent of and configured separately from the hull 2.

As shown in FIG. 6, the second jet pump 31 is installed in the hull 2 with the electric motor 30 being attached to the second jet pump 31. That is, the electric motor 30 and the second jet pump 31 are unitized to define a main unit installable in the hull 2. As shown in FIG. 7, the second jet pump 31 includes an attachment portion 32 that covers the lower side of the housing portion 2*e*. The attachment portion 32 defines a portion of the vessel bottom and is attached to the hull 2 using multiple bolts 33 as an example of fixing members. With this arrangement, the electric motor 30 and the second jet pump 31 are installed in the hull 2.

The second jet pump 31 is arranged to be driven by the electric motor 30 to take in water through the vessel bottom and jet the water rearward. As shown in FIG. 5, the second jet pump 31 includes a second defining member 34 including a second flow path 43, a second impeller 35 and a second stator vane 36 disposed in the second flow path 43, and a support mechanism 37 rotatably supporting the second impeller 35. The second jet pump 31 further includes a second grid screen 38 arranged to prevent entry of foreign matter into the second flow path 43, a motor attachment portion 39 to which the electric motor 30 is attached, and a second drive shaft 40 arranged to transmit rotation between the second impeller 35 and the electric motor 30.

As shown in FIG. 5, the second defining member 34 includes a second water inlet 41 (second inlet) opened downward at the vessel bottom, a second jet nozzle 42 (second outlet) opened rearward posterior to the second water inlet 41, and the second flow path 43 connecting the second water inlet 41 and the second jet nozzle 42. The second flow path 43 extends rearward from the second water inlet 41 obliquely upward. The second defining member 34 includes a second duct 44 defining the second water inlet 41, a cylindrical rotor vane housing 45 surrounding the second impeller 35, a cylindrical stator vane housing 46 surrounding the second stator vane 36, and the second nozzle 47 defining the second jet nozzle 42. The second defining member 34 may be integrated with or separate from the attachment portion 32. Alternatively, a portion of the second defining member 34 (e.g., second duct 44) may be integrated with the attachment portion 32.

As shown in FIG. 5, the rotor vane housing 45, the stator vane housing 46, and the second nozzle 47 have a longitudinally extending cylindrical shape. The stator vane housing 46 is arranged posterior to the rotor vane housing 45, and the second nozzle 47 is arranged posterior to the stator vane housing 46. The inside diameter of the rear end portion of the second nozzle 47 is smaller than that of the front end portion of the second nozzle 47. The second jet nozzle 42 includes the rear end portion of the second nozzle 47. The stator vane housing 46 and the second nozzle 47 define the second flow path 43 downstream of the second impeller 35, while the second duct 44 defines the second flow path 43 upstream of the second impeller 35. The second screen 38 is attached to the second duct 44 and disposed along the second water inlet 41 above the vessel bottom. The second screen 38 is arranged to prevent entry of foreign matter from the second water inlet 41 into the second flow path 43.

As shown in FIG. 8, the second impeller 35 is disposed upstream from the second stator vane 36 and the support mechanism 37 (nearer to the second water inlet 41). The second impeller 35 includes multiple blades (rotor vanes) arranged around a longitudinally extending second rotational axis A2. Similarly, the second stator vane 36 includes multiple blades arranged around the second rotational axis A2 posterior to the second impeller 35. The support mechanism 37 includes a longitudinally extending streamlined housing 48 and a rotary shaft 49 supported rotatably on the housing 48. The housing 48 is arranged in the stator vane housing 46 and the second nozzle 47. The second stator vane 36 is arranged around the housing 48 and extends from the housing 48 to the stator vane housing 46. The second stator vane 36 is fixed to the housing 48 and the stator vane housing 46. As a result, the second stator vane 36 is not rotatable with respect to the second flow path 43. The housing 48 supports the rotary shaft 49 via multiple bearings 50 arranged inside the housing 48. The rotary shaft 49 extends along the second rotational axis A2 and protrudes forward from the housing 48. The second impeller 35 is coupled to the rotary shaft 49 using, for example, a screw. As a result, the second impeller 35 and the rotary shaft 49 are rotatable about the second rotational axis A2 with respect to the second flow path 43.

On the other hand, as shown in FIG. 5, the motor attachment portion 39 is arranged between the second duct 44 and the hull 2. The motor attachment portion 39 may be integrated with or separate from the second duct 44. The second duct 44 includes a duct slanted portion 44*a* extending rearward and obliquely upward. The motor attachment portion 39 is coupled to the duct slanted portion 44*a* and arranged anterior to the second duct 44. The motor attachment portion 39 is thus arranged anterior to the second impeller 35. Further, the motor attachment portion 39 is arranged above the second water inlet 41. Therefore, the front end 41*a* of the second water inlet 41 is positioned anterior to the motor attachment portion 39. The motor attachment portion 39 is arranged in a motor space S1 defined by the hull 2 and the second jet pump 31. Similarly, the electric motor 30 is also arranged in the motor space S1. The electric motor 30 is attached to the motor attachment portion 39 via a cylindrical spacer 51. The electric motor 30 is held on the motor attachment portion 39 with the output shaft 30*a* thereof being directed rearward. The output shaft 30*a* of the electric motor 30 is arranged on the second rotational axis A2 to be coaxial with the second drive shaft 40. The electric motor 30 is arranged below the water level when the marine vessel 1 is in a stationary state.

As shown in FIG. 5, the second drive shaft 40 extends longitudinally between the electric motor 30 and the second impeller 35. A large portion of the second drive shaft 40 is arranged in the second flow path 43. The second drive shaft 40 is inserted in a through-hole longitudinally penetrating the motor attachment portion 39 and the second duct 44. The second drive shaft 40 includes a front end portion 40*a* arranged to rotate together with the output shaft 30*a* of the electric motor 30, a rear end portion 40*b* arranged to rotate together with the second impeller 35, and an intermediate portion 40*c* arranged between the front end portion 40*a* and the rear end portion 40*b*. As shown in FIG. 9, the front end portion 40*a* is coupled to the output shaft 30*a* of the electric motor 30 in, for example, a splined manner. The front end portion 40*a* is inserted into and supported on the spacer 51 via a bearing 52. Further, an annular seal 53 provides a tight seal between the front end portion 40*a* and the spacer 51. This prevents entry of water from the second flow path 43 into the electric motor 30. As shown in FIG. 5, the rear end portion 40*b* is coupled to the rotary shaft 49 in, for example, a splined manner. The front and rear end portions 40*a*, 40*b* are coupled to the intermediate portion 40*c*. The second drive shaft 40 is supported with the outer peripheral surface of the intermediate portion 40*c* being not in contact with the second jet pump 31. The second drive shaft 40 is independent of and completely or approximately parallel with the first drive shaft 16 in the first propulsion unit 4 (see FIG. 2).

As shown in FIG. 9, the second propulsion unit 5 further includes a battery 54 that supplies power to the motor ECU 29. The motor ECU 29 and the battery 54 are arranged inside the hull 2. The battery 54 is connected to the motor ECU 29 via a power supply wire 55, and in turn the motor ECU 29 is connected to the electric motor 30 via a power supply wire 56. The power supply wires 55, 56 are multi-core ones including multiple cables covered with an insulator. The power supply wire 56 extends from inside to outside the hull 2 through a first through-hole 57 defined in the hull 2. A first cylindrical seal 58 composed of an elastic material such as rubber or a resin provides a tight seal between the inner peripheral surface of the first through-hole 57 and the power supply wire 56. The electricity of the battery 54 is supplied via the motor ECU 29 to the electric motor 30. The motor ECU 29 is arranged and programmed to control power supplied to the electric motor 30 based on an output command that the vessel operator has input with the output control lever 8 (see FIG. 2). Accordingly, the second jet pump 31 is driven by the electric motor 30.

The electric motor 30 (output shaft 30*a*) is rotatable in a normal direction and in a reverse direction. When the electric motor 30 rotates in the normal direction (e.g., clockwise direction from a rear view), the second impeller 35 also rotates in a normal direction. This causes water to be taken through the second water inlet 41 into the second flow path 43 to be fed through the second impeller 35 to the second stator vane 36. The flow of water, though twisted due to the rotation of the second impeller 35, is aligned by the second stator vane 36. Thus, the aligned water is fed from the second stator vane 36 to the second nozzle 47 and jetted rearward through the second jet nozzle 42. This results in a jet flow of water and therefore a thrust force in the forward direction. On the contrary, when the electric motor 30 rotates in the reverse direction, the second impeller 35 also rotates in a reverse direction. This causes water to be taken through the second jet nozzle 42 into the second flow path 43 to be jetted forward through the second water inlet 41 obliquely downward. This results in a thrust force in the backward direction. The second propulsion unit 5 is thus arranged to change the direction of the thrust force by switching the rotation direction of the second impeller 35.

As shown in FIG. 5, the second propulsion unit 5 further includes a motor cooling device 59 arranged to cool the electric motor 30. The motor cooling device 59 is of a water-cooled type arranged outside the hull 2. The motor cooling device 59 includes a cooling water pipe 60 extending from the second flow path 43 to the electric motor 30 between the hull 2 and the second jet pump 31, and a water jacket 61 attached to the electric motor 30. The cooling water pipe 60 is arranged above the second jet pump 31. The front end portion of the cooling water pipe 60 is connected to an inflow port 61*a* of the water jacket 61 (see FIG. 9), while the rear end portion of the cooling water pipe 60 is connected to the second flow path 43 downstream from the second impeller 35. The rear end portion of the cooling water pipe 60 may be attached to the stator vane housing 46 or the second nozzle 47.

Since the second impeller 35 feeds water rearward while rotating in the normal direction, the water pressure in the stator vane housing 46 and the second nozzle 47 accordingly increases. This causes the water in the second flow path 43 to be fed to the cooling water pipe 60. The water fed to the cooling water pipe 60 flows into the water jacket 61 through the inflow port 61*a*. The water flowing into the water jacket 61 is then discharged through an outflow port 61*b* of the water jacket 61 (see FIG. 9). The water discharged from the water jacket 61 runs through the gap between the hull 2 and the attachment portion 32 to be discharged from the motor space 51. Thus, cooling water flows constantly inside the water jacket 61 while the electric motor 30 rotates in the normal direction. The low-temperature cooling water is thus supplied reliably to the water jacket 61. Accordingly, the electric motor 30 can be reliably cooled.

Figure 10:
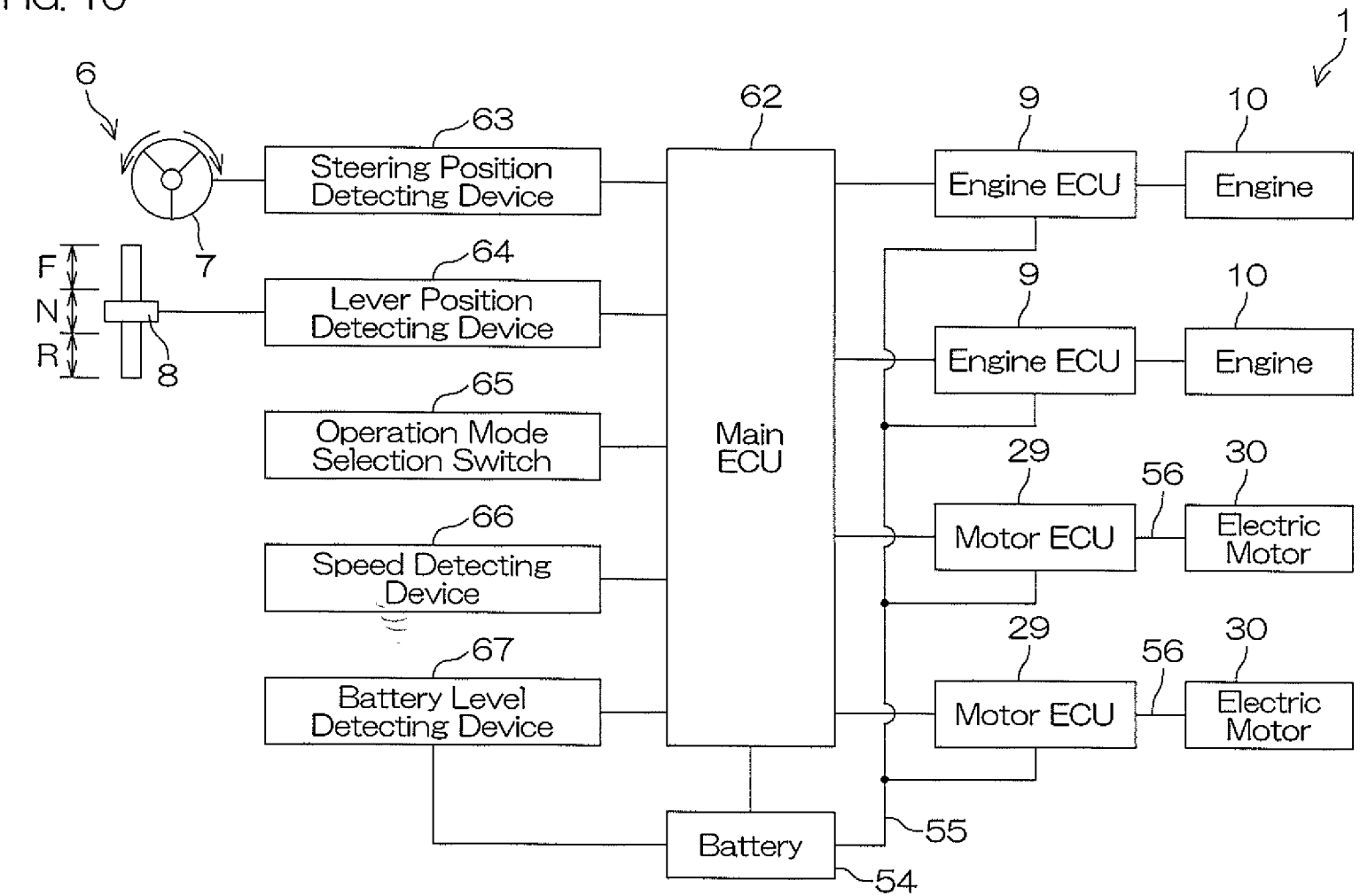
FIG. 10 illustrates the electrical configuration of the marine vessel according to the first preferred embodiment of the present invention.

FIG. 10 illustrates the electrical configuration of the marine vessel 1 according to the first preferred embodiment of the present invention.

The marine vessel 1 further includes a main ECU 62 that controls the traveling of the marine vessel 1. As mentioned above, each first propulsion unit 4 includes an engine ECU 9, and each second propulsion unit 5 includes a motor ECU 29. The engine ECU 9 and the motor ECU 29 are connected electrically to the main ECU 62. The main ECU 62 is programmed to control the engine ECU 9 and the motor ECU 29. The two engine ECUs 9 are programmed to control the two respective engines 10, while the two motor ECUs 29 are programmed to control the two respective electric motors 30.

The operation unit 6 includes a steering position detecting device 63 that detects the steering position of the steering wheel 7. The steering position detecting device 63 is connected electrically to the main ECU 62. The steering wheel 7 is movable (rotatable) between a maximum left-handed steering position and a maximum right-handed steering position. The steering wheel 7 is arranged to be operated by the vessel operator to take any position between the maximum left-handed steering position and the maximum right-handed steering position. The straight traveling position is provided between the maximum left-handed steering position and the maximum right-handed steering position. In the straight traveling position, the marine vessel 1 travels straight forward or backward. The steering wheel 7 is connected mechanically or electrically to the first deflector 17 (see FIG. 4). When the steering wheel 7 is situated nearer to the maximum left-handed steering position in relation to the straight traveling position, the first deflector 17 is tilted leftward. On the contrary, when the steering wheel 7 is situated nearer to the maximum right-handed steering position in relation to the straight traveling position, the first deflector 17 is tilted rightward.

The operation unit 6 further includes a lever position detecting device 64 arranged to detect the shift position of the output control lever 8. The lever position detecting device 64 is connected electrically to the main ECU 62. The output control lever 8 is movable among F-, N-, and R-ranges. The output control lever 8 is arranged to be operated by the vessel operator to take any position among the F-, N-, and R-ranges. When the lever 8 is situated in the F-range, the marine vessel 1 travels forward. When the lever 8 is situated in the R-range, the marine vessel 1 travels backward. The N-range is provided between the F- and R-ranges. The output control lever 8 is connected mechanically or electrically to the first bucket 12 (see FIG. 4). When the output control lever 8 is situated in the F-range, the forward traveling jet nozzle 27 of the first deflector 17 is not covered with the first bucket 12. When the output control lever 8 is situated in the R-range, the forward traveling jet nozzle 27 of the first deflector 17 is covered with the first bucket 12.

The main ECU 62 is arranged and programmed to control the engine ECU 9 and the motor ECU 29 to propel the marine vessel 1 with at least one of the first and second propulsion units 4, 5. The marine vessel 1 further includes an operation mode selection switch 65 to be operated by the vessel operator. The operation mode selection switch 65 is connected electrically to the main ECU 62. The vessel operator can operate the operation mode selection switch 65 to select one of the operation modes of the marine vessel 1. The main ECU 62 is arranged and programmed to operate the marine vessel 1 in the operation mode selected by the vessel operator. The operation modes of the marine vessel 1 include a manual mode. In the manual mode, the vessel operator can further select an engine mode of using only the pair of first propulsion units 4 to propel the marine vessel 1, an electric mode of using only the pair of second propulsion units 5 to propel the marine vessel 1, or an assist mode of using both the first propulsion units 4 and the second propulsion units 5 to propel the marine vessel 1. The operation modes of the marine vessel 1 further include an automatic selection mode in which the main ECU 62 selects any one of the engine mode, the electric mode, and the assist mode.

The marine vessel 1 further includes a speed detecting device 66 that detects the speed of the marine vessel 1 and a battery level detecting device 67 that detects the remaining level of the battery 54. The speed detecting device 66 and the battery level detecting device 67 are connected electrically to the main ECU 62. The criterion on which the selection of mode by the main ECU 62 in the automatic selection mode is based may be, for example, the speed of the marine vessel 1 or the remaining level of the battery 54. The selection of mode may be based on both the speed and the remaining level or a criterion other than the speed and the remaining level.

If the selection of mode is based on the speed of the marine vessel 1, for example, and in the case of a low-speed range in which the speed of the marine vessel 1 is lower than a predetermined first speed (e.g., 5 miles/hour), the main ECU 62 uses only the pair of second propulsion units 5 to propel the marine vessel 1 (electric mode). In the case of a middle-speed range in which the speed of the marine vessel 1 is equal to or higher than the first speed but lower than a second speed that is higher than the first speed, the main ECU 62 uses the first and second propulsion units 4, 5 to propel the marine vessel 1 (assist mode). In the case of a high-speed range in which the speed of the marine vessel 1 is equal to or higher than the second speed, the main ECU 62 uses only the pair of first propulsion units 4 to propel the marine vessel 1 (engine mode). The first speed may be constant or variable. Similarly, the second speed also may be constant or variable.

Described hereinafter are the cases where the engine mode in the manual mode is selected and where the electric mode in the manual mode is selected. When the engine mode in the manual mode is selected, the marine vessel 1 is propelled with the pair of first propulsion units 4 independently of the speed. Similarly, when the electric mode in the manual mode is selected, the marine vessel 1 is propelled with the pair of second propulsion units 5 independently of the speed. The description of the assist mode is omitted because of its similarity to the case where the electric mode and the engine mode are parallelized.

Engine Mode

Figure 11:
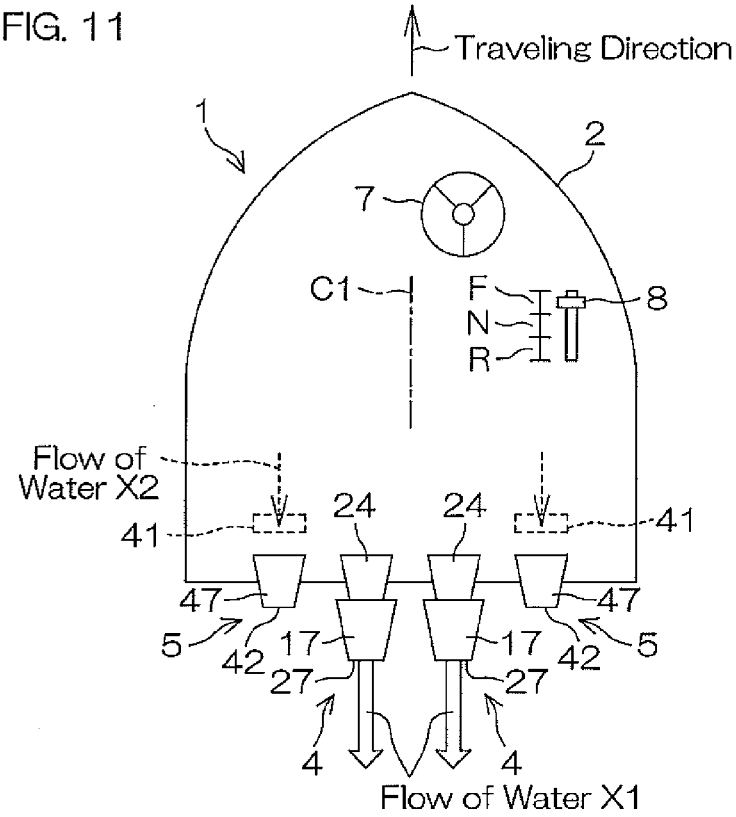
FIG. 11 is a schematic plan view when the marine vessel travels forward with a pair of first propulsion units.

FIG. 11 is a schematic plan view when the marine vessel 1 travels forward with use of the pair of first propulsion units 4.

The vessel operator situates the steering wheel 7 at the straight traveling position and the output control lever 8 in the F-range to make the marine vessel 1 travel straight forward. As a result, the two first deflectors 17 are situated such that the jet flow of water from the forward traveling jet nozzle 27 is directed longitudinally in a plan view, and the two first buckets 12 (see FIG. 4) are situated at the forward traveling position (where the forward traveling jet nozzle 27 is not covered). Further, the main ECU 62 inputs a command to the two engine ECUs 9 to make the engine ECUs 9 control the two respective engines 10 to have substantially the same output power. This causes water to be jetted longitudinally from the two forward traveling jet nozzles 27 in a plan view. In addition, the water is jetted rearward from the two forward traveling jet nozzles 27 to define a flow of water X1. Since the two engines 10 have substantially the same output power, the first propulsion units 4 generate substantially the same thrust force. Further, the pair of first propulsion units 4 are disposed laterally symmetrical. Therefore, the rearward jet flow of water from the two forward traveling jet nozzles 27 applies a forward force (in parallel or substantially parallel with the vessel center C1) on the hull 2, whereby the marine vessel 1 travels straight forward without rotating laterally.

When the marine vessel 1 is propelled only with the first propulsion units 4, the second impeller 35 (see FIG. 5) cannot rotate to generate a suction force to take water through the second water inlet 41 into the second flow path 43. However, the traveling of the marine vessel 1 causes a water pressure on the second water inlet 41 to result in an inflow of water through the second water inlet 41 into the second flow path 43. That is, the traveling of the marine vessel 1 causes a flow of water X2 flowing through the second water inlet 41 into the second flow path 43. The water flowing into the second flow path 43 then flows toward the second jet nozzle 42 to cause a pressure (water pressure) on and rotate the second impeller 35. The rotation of the second impeller 35 is transmitted to the electric motor 30 via the second drive shaft 40. This drives the electric motor 30 to rotate and generate power. The power generated by the electric motor 30 is then supplied to and stored in the battery 54. When the marine vessel 1 is thus propelled with the pair of first propulsion units 4 while the pair of second propulsion units 5 generate no thrust force, the electric motor 30 generates power and charges the battery 54.

Figure 12:
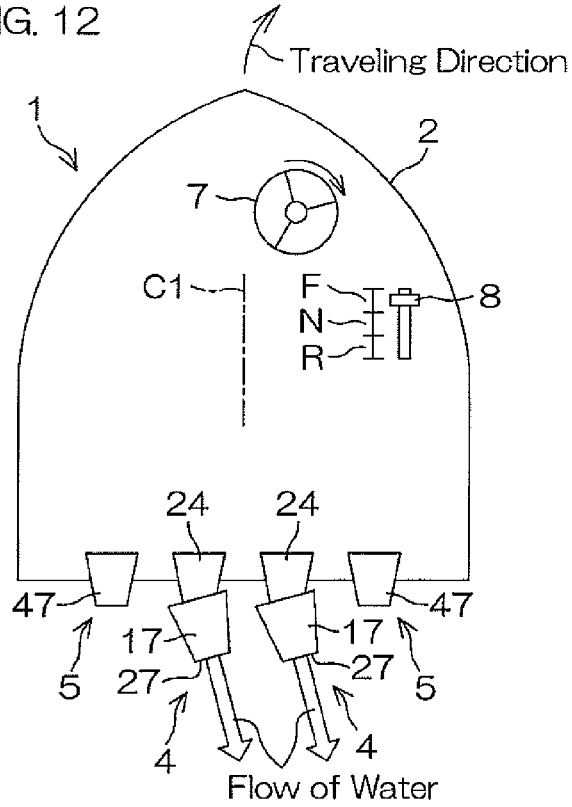
FIG. 12 is a schematic plan view when the marine vessel rotates while traveling forward with the pair of first propulsion units.

FIG. 12 is a schematic plan view when the marine vessel 1 rotates while traveling forward with the pair of first propulsion units 4.

The vessel operator steers the steering wheel 7 (the steering wheel 7 is nearer to the maximum right-handed steering position or the maximum left-handed steering position in relation to the straight traveling position) and situates the output control lever 8 in the F-range to make the marine vessel 1 rotate while traveling forward. As a result, the two first deflectors 17 are situated such that the jet flow of water from the forward traveling jet nozzle 27 is tilted laterally with respect to the longitudinal direction in a plan view, and the two first buckets 12 (see FIG. 4) are situated at the forward traveling position. Further, the main ECU 62 inputs a command to the two engine ECUs 9 to make the engine ECUs 9 control the two respective engines 10 to have substantially the same output power. This causes water to be jetted in a direction tilted with respect to the longitudinal direction from the two forward traveling jet nozzles 27 in a plan view. That is, the rearward jet flow of water from the two forward traveling jet nozzles 27 applies a forward rotational force on the hull 2. Accordingly, the marine vessel 1 travels forward while rotating at an angle according to the steering position of the steering wheel 7.

Electric Mode

Figure 13:
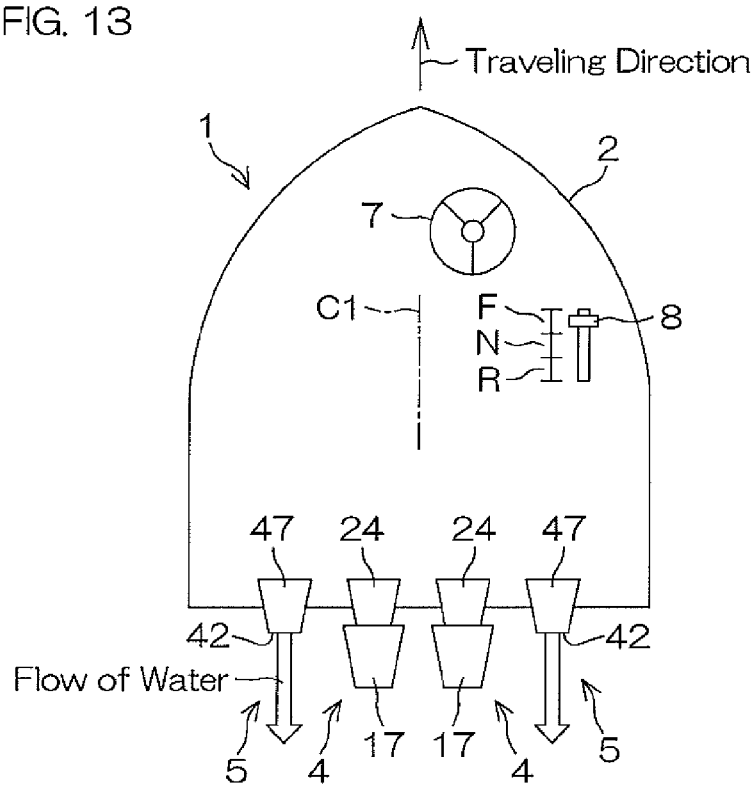
FIG. 13 is a schematic plan view when the marine vessel travels forward with a pair of second propulsion units.

FIG. 13 is a schematic plan view when the marine vessel 1 travels forward with use of the pair of second propulsion units 5.

The vessel operator situates the steering wheel 7 at the straight traveling position and the output control lever 8 in the F-range to make the marine vessel 1 travel straight forward. When the steering wheel 7 is situated at the straight traveling position and the output control lever 8 is situated in the F-range, the main ECU 62 inputs a command to the two motor ECUs 29 to make the motor ECUs 29 control the two respective electric motors 30 to have substantially the same output power. This drives the two second impellers 35 (see FIG. 5) to rotate in the normal direction and thereby causes water to be jetted longitudinally from the two second jet nozzles 42 in a plan view. Since the two electric motors 30 have substantially the same output power, the second propulsion units 5 generate substantially the same thrust force. Further, the pair of second propulsion units 5 are disposed laterally symmetrical. Therefore, the rearward jet flow of water from the two second jet nozzles 42 applies a forward force on the hull 2, whereby the marine vessel 1 travels straight forward without rotating laterally.

Figure 14:
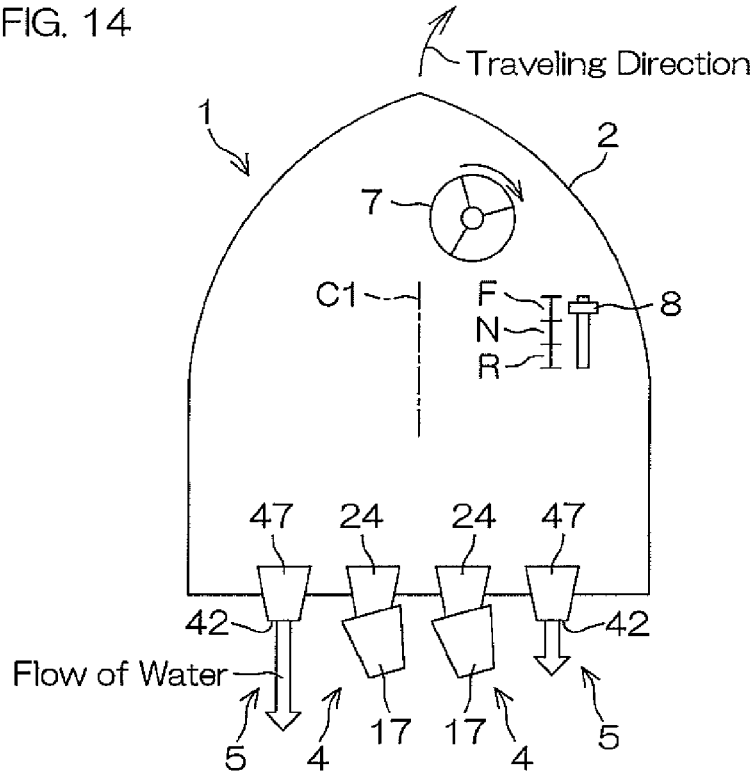
FIG. 14 is a schematic plan view when the marine vessel rotates while traveling forward with the pair of second propulsion units.

FIG. 14 is a schematic plan view when the marine vessel 1 rotates while traveling forward with use of the pair of second propulsion units 5.

The vessel operator steers the steering wheel 7 and situates the output control lever 8 in the F-range to make the marine vessel 1 rotate while traveling forward. When the steering wheel 7 is steered and the output control lever 8 is situated in the F-range, the main ECU 62 inputs a command to the two motor ECUs 29 to make the motor ECUs 29 control the two respective electric motors 30 to have their respective different output powers. This drives the two second impellers 35 to rotate in the normal direction and thereby causes water to be jetted longitudinally from the two second jet nozzles 42 in a plan view. Since the two electric motors 30 have their respective different output powers, the two second propulsion units 5 also generate their respective different thrust forces. Further, the pair of second propulsion units 5 are disposed laterally symmetrical. Therefore, the rearward jet flow of water from the two second jet nozzles 42 applies a force on the hull 2 to more forward while rotating, whereby the marine vessel 1 travels forward while rotating at an angle according to the steering position of the steering wheel 7. That is, the main ECU 62 controls the two motor ECUs 29 such that the pair of second propulsion units 5 generate their respective different thrust forces, so that the marine vessel 1 rotates.

In the above-described first preferred embodiment, the second jet pump 31 is arranged outside the hull 2 and the electric motor 30 is arranged between the hull 2 and the second jet pump 31. There is thus no need to perform work to couple the second jet pump 31 and the electric motor 30 using a shaft penetrating the hull 2. There is accordingly no need to perform work to couple the shaft and the electric motor 30 in the hull 2. Further, there is no need to provide a through-hole in the hull 2 through which the shaft is inserted. This can prevent entry of water into the marine vessel.

Further, the electric motor 30, which is arranged between the hull 2 and the second jet pump 31, may be larger as compared to the case where the electric motor 30 would be arranged inside the second jet pump 31. This can increase the maximum output of the second jet pump 31.

Moreover, the electric motor 30 and the second jet pump 31, which are unitized, need not be installed in the hull 2 separately. This facilitates the installation of the electric motor 30 and the second jet pump 31 into the hull 2. In addition, the electric motor 30, which is detachable from the second jet pump 31, may be replaced in accordance with a required maximum output of the second propulsion units 5.

Second Preferred Embodiment

Next, a second preferred embodiment of the present invention will be described.

The second preferred embodiment is different from the above-described first preferred embodiment mainly in that the second propulsion units are provided with a second deflector that laterally changes the direction of jet flow and a second bucket that longitudinally changes the direction of jet flow.

Figure 15:
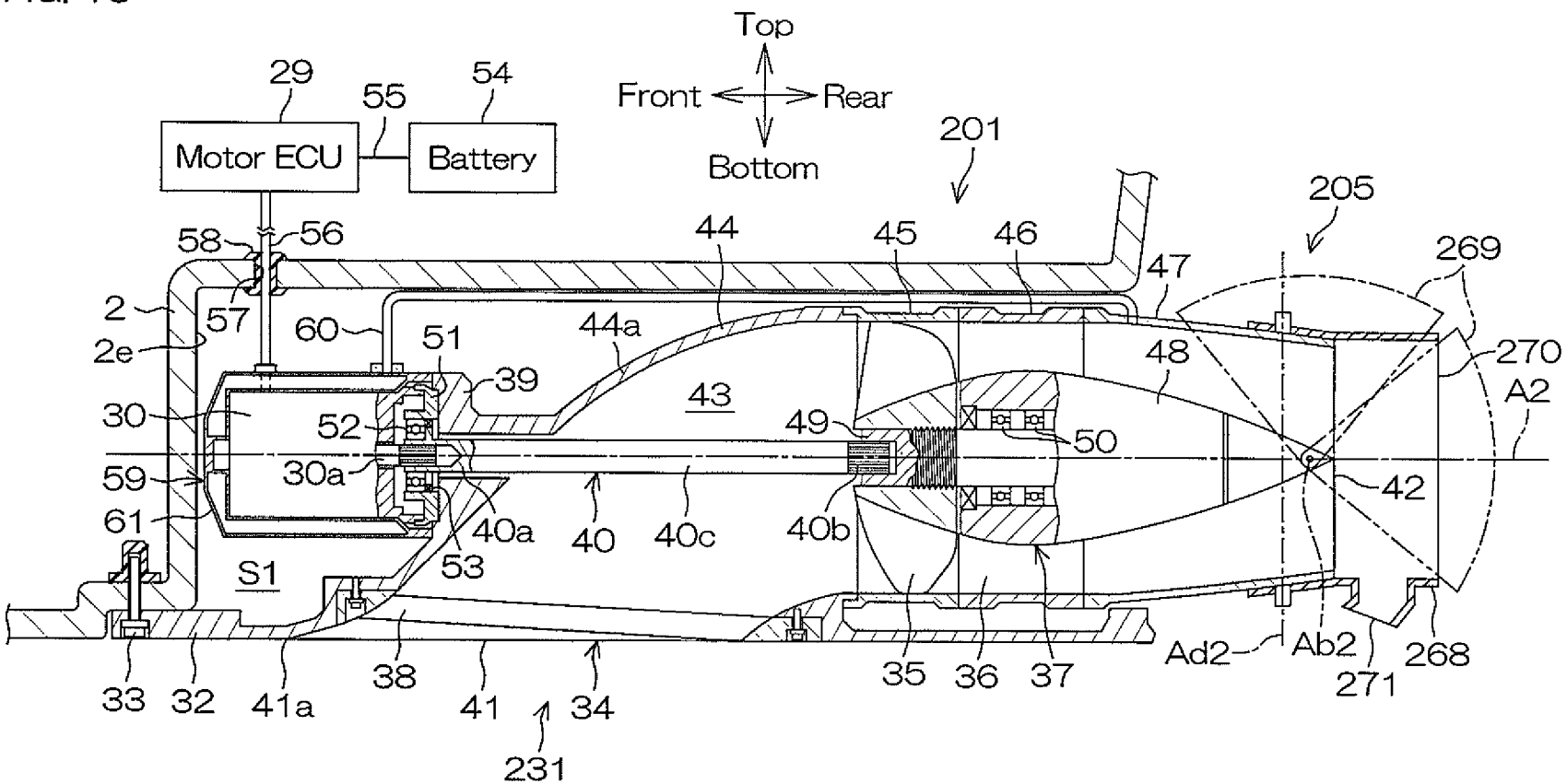
FIG. 15 is a sectional view of a second propulsion unit according to a second preferred embodiment of the present invention.

FIG. 15 is a sectional view of a second propulsion unit 205 according to the second preferred embodiment of the present invention. In FIG. 15, components corresponding to those shown in FIGS. 1 to 14 are designated by the same reference numerals as in FIG. 1, etc., to omit the description thereof.

The marine vessel 201 according to the second preferred embodiment includes a second propulsion unit 205, instead of the second propulsion unit 5 according to the first preferred embodiment. The second propulsion unit 205 preferably has a structure similar to that of the second propulsion unit 5 according to the first preferred embodiment. That is, the second propulsion unit 205 includes a second jet pump 231, instead of the second jet pump 31 according to the first preferred embodiment. The second jet pump 231 includes a second cylindrical deflector 268 that laterally changes the direction of jet flow, in addition to the configuration of the second jet pump 31 according to the first preferred embodiment. The second propulsion unit 205 further includes a second bucket 269 that longitudinally changes the direction of jet flow.

The second deflector 268 is coupled to the second nozzle 47 in a manner laterally rotatable about a vertically extending deflector rotational axis Ad2. The second deflector 268 is hollow. The second jet nozzle 42 is arranged in the second deflector 268. The second deflector 268 defines a forward traveling jet nozzle 270 opened rearward and a backward traveling jet nozzle 271 opened obliquely forward. The forward traveling jet nozzle 270 is arranged posterior to the second jet nozzle 42, and the backward traveling jet nozzle 271 is arranged below the forward traveling jet nozzle 270.

The second deflector 268 is laterally rotatable with respect to the second nozzle 47 centering on a straight traveling position. The straight traveling position is a position where the direction of water jetted from the forward traveling jet nozzle 270 and the backward traveling jet nozzle 271 is longitudinal in a plan view. The second deflector 268 is arranged to be rotated laterally about the deflector rotational axis Ad2 when the steering wheel 7 is operated by the vessel operator. This causes the direction of jet flow to be changed laterally, so that the marine vessel 201 is steered.

The second bucket 269 is arranged to rotate laterally about the deflector rotational axis Ad2 together with the second deflector 268. The second bucket 269 is coupled to the second deflector 268 in a manner rotatable about a laterally extending bucket rotational axis Ab2. The second bucket 269 is movable between a backward traveling position (indicated by the alternate long and two short dashed lines) and a forward traveling position (indicated by the alternate long and short dashed lines). The backward traveling position is a position where the forward traveling jet nozzle 270 is covered with the second bucket 269 in a rear view, while the forward traveling position is a position where the forward traveling jet nozzle 270 is not covered with the second bucket 269 in a rear view. The backward traveling jet nozzle 271 is arranged to jet water therefrom when the second bucket 269 is situated in the backward traveling position. The second bucket 269 is arranged to move between the forward traveling position and the backward traveling position when the output control lever 8 (see FIG. 2) is operated by the vessel operator. This causes the direction of jet flow to be changed longitudinally, so that the traveling direction of the marine vessel 201 is switched.

Third Preferred Embodiment

Next, a third preferred embodiment of the present invention will be described.

The third preferred embodiment is different from the above-described first preferred embodiment mainly in that the motor cooling device is provided with a discharge portion that discharges water fed from the second jet pump toward the electric motor.

Figure 16:
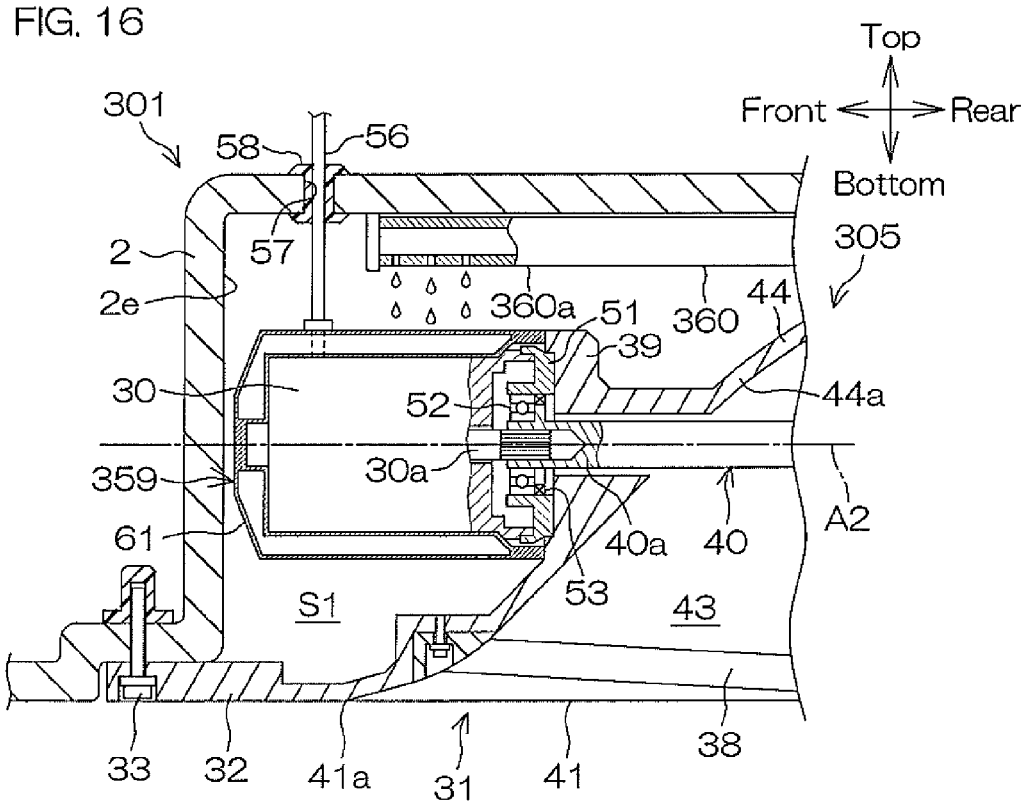
FIG. 16 is a partial sectional view of a second propulsion unit according to a third preferred embodiment of the present invention.

FIG. 16 is a partial sectional view of a second propulsion unit 305 according to the third preferred embodiment of the present invention. In FIG. 16, components corresponding to those shown in FIGS. 1 to 15 are designated by the same reference numerals as in FIG. 1, etc., to omit the description thereof.

The marine vessel 301 according to the third preferred embodiment preferably has a structure similar to that of the marine vessel 1 according to the first preferred embodiment. That is, the marine vessel 301 includes a second propulsion unit 305, instead of the second propulsion unit 5 according to the first preferred embodiment. The second propulsion unit 305 preferably has a structure similar to that of the second propulsion unit 5 according to the first preferred embodiment, excluding the motor cooling device. That is, the second propulsion unit 305 includes a motor cooling device 359, instead of the motor cooling device 59 according to the first preferred embodiment. The motor cooling device 359 includes a cooling water pipe 360 extending from the second flow path 43 to the electric motor 30 between the hull 2 and the second jet pump 31. The cooling water pipe 360 is arranged above the second jet pump 31. The cooling water pipe 360 includes a discharge portion 360*a* that discharges cooling water supplied from the second flow path 43 into the cooling water pipe 360 toward the electric motor 30. When the second impeller 35 (see FIG. 5) rotates in the normal direction, the discharge portion 360*a* discharges cooling water toward the electric motor 30. This cools the electric motor 30.

Fourth Preferred Embodiment

Next, a fourth preferred embodiment of the present invention will be described.

The fourth preferred embodiment is different from the above-described first preferred embodiment mainly in the arrangement of the motor ECU and the wiring associated with the electric motor. Besides these, the marine vessel 401 according to the fourth preferred embodiment preferably has a structure similar to that of the marine vessel 1 according to the first preferred embodiment.

Figure 17A:
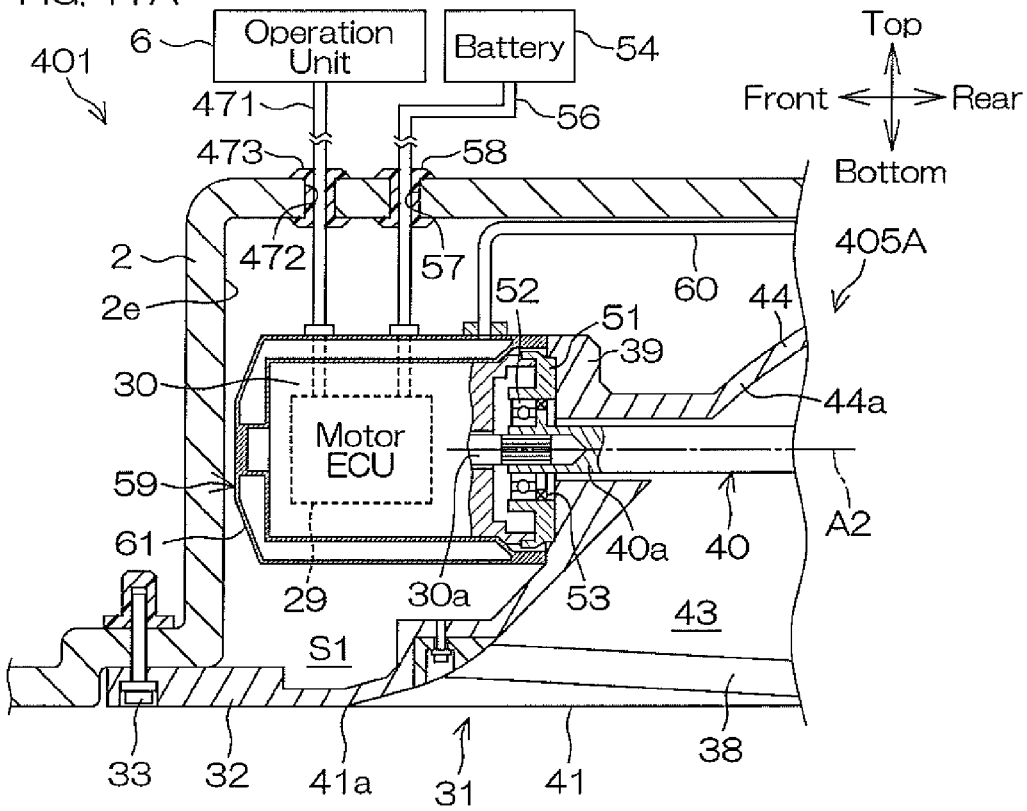
FIG. 17A is a partial sectional view of a second propulsion unit according to a fourth preferred embodiment of the present invention.
Figure 17B:
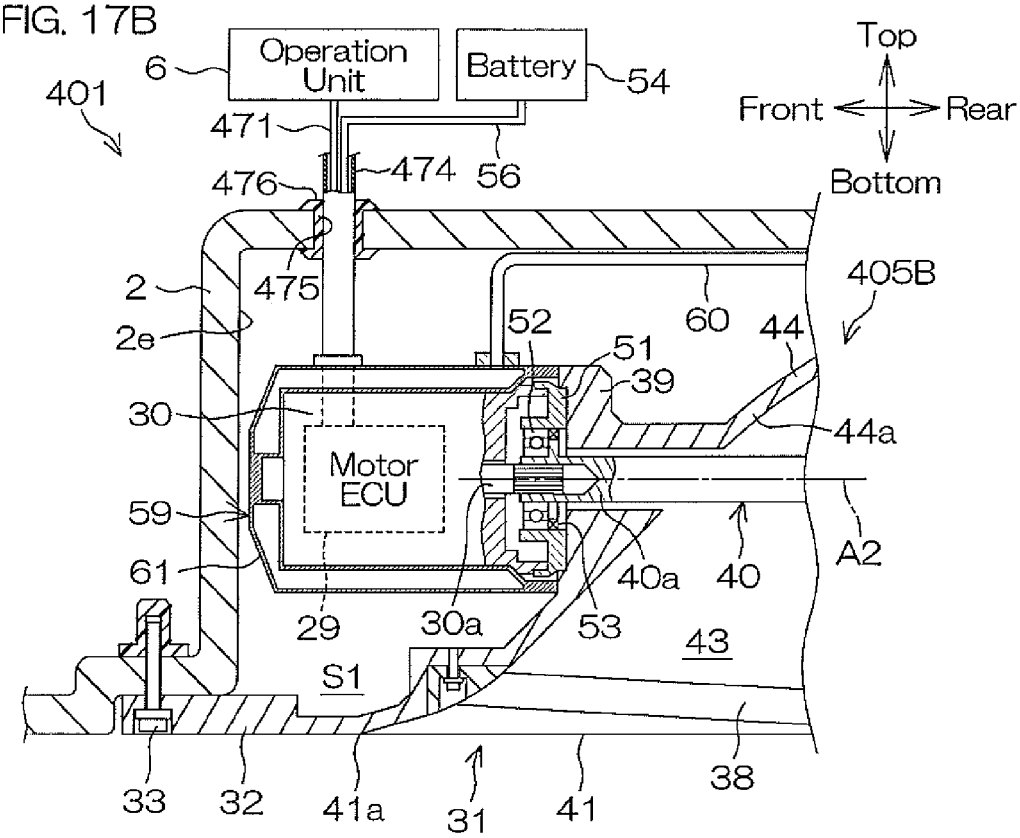
FIG. 17B is a partial sectional view of a second propulsion unit according to the fourth preferred embodiment of the present invention.
Figure 17C:
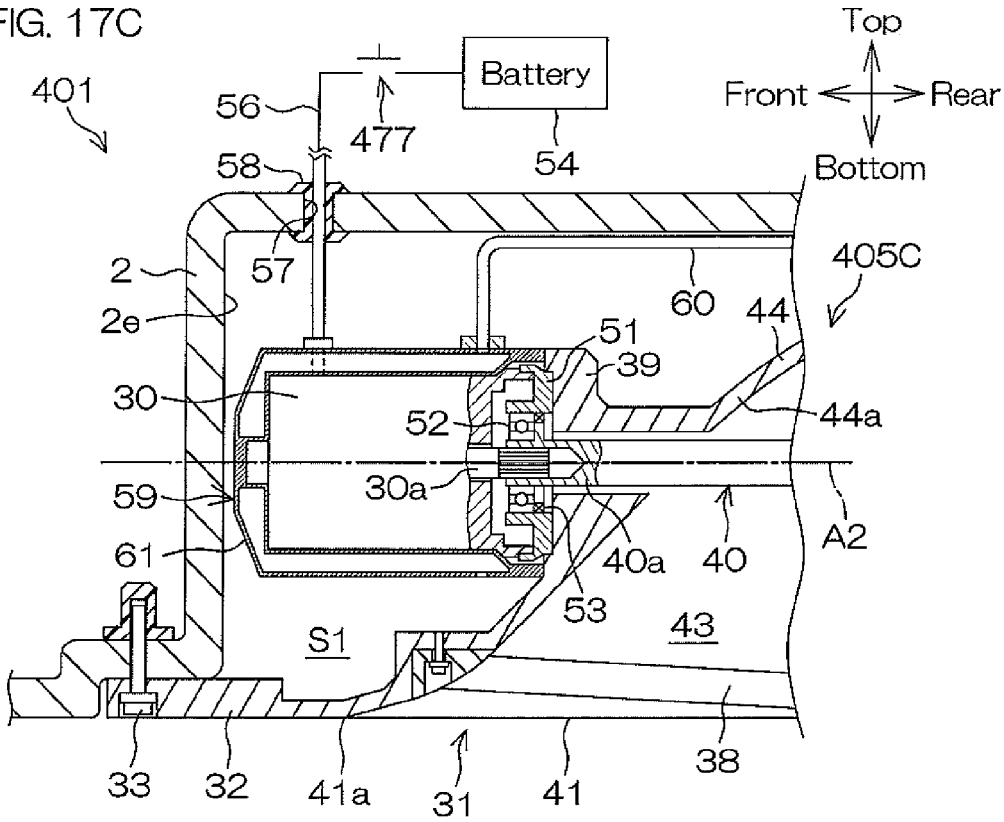
FIG. 17C is a partial sectional view of a second propulsion unit according to the fourth preferred embodiment of the present invention.

FIGS. 17A, 17B, and 17C are partial sectional views of second propulsion units 405A, 405B, and 405C according to the fourth preferred embodiment of the present invention. In FIGS. 17A, 17B, and 17C, components corresponding to those shown in FIGS. 1 to 16 are designated by the same reference numerals as in FIG. 1, etc., to omit the description thereof.

In the first preferred embodiment, the motor ECU 29 is arranged in the hull 2. However, the motor ECU 29 may be arranged outside the hull 2 as shown in FIGS. 17A and 17B. Also, in the case of not controlling the output torque of the electric motor 30, the motor ECU 29 may not be provided between the electric motor 30 and the battery 54 as shown in FIG. 17C.

Specifically, in the second propulsion unit 405A shown in FIG. 17A, the motor ECU 29 is located in the electric motor 30. The motor ECU 29 and the electric motor 30 are connected electrically to each other. The motor ECU 29 is also connected to the battery 54 through a power supply wire 56. The motor ECU 29 is further connected to the operation unit 6 through a control wire 471. The motor ECU 29 may be connected to the operation unit 6 directly or via an intermediate device such as the main ECU 62 (see FIG. 10). That is, the intermediate device may be connected to the control wire 471 between the motor ECU 29 and the operation unit 6.

The control wire 471 is of a multi-core type including multiple cables covered with an insulator, through which a control signal is transmitted between the operation unit 6 and the motor ECU 29. As shown in FIG. 17A, the power supply wire 56 extends from inside to outside the hull 2 through a first through-hole 57 provided in the hull 2. A first cylindrical seal 58 provides a tight seal between the inner peripheral surface of the first through-hole 57 and the power supply wire 56. Similarly, the control wire 471 extends from inside to outside the hull 2 through a second through-hole 472 provided in the hull 2. A second cylindrical seal 473 composed of an elastic material provides a tight seal between the inner peripheral surface of the second through-hole 472 and the control wire 471.

In the second propulsion unit 405B shown in FIG. 17B, the motor ECU 29 is located in the electric motor 30. The motor ECU 29 and the electric motor 30 are connected electrically to each other. The motor ECU 29 is also connected to the battery 54 through a power supply wire 56. The motor ECU 29 is further connected to the operation unit 6 through a control wire 471. The motor ECU 29 may be connected to the operation unit 6 directly or via an intermediate device. The power supply wire 56 and the control wire 471 are covered with a cylindrical insulator 474. The power supply wire 56, the control wire 471, and the insulator 474 constitute a collective wire. The collective wire extends from inside to outside the hull 2 through a common through-hole 475 provided in the hull 2. A common cylindrical seal 476 composed of an elastic material provides a tight seal between the inner peripheral surface of the common through-hole 475 and the collective wire. The common seal 476 thus provides a tight seal between the inner peripheral surface of the common through-hole 475 and the power supply wire 56 as well as between the inner peripheral surface of the common through-hole 475 and the control wire 471.

In the second propulsion unit 405C shown in FIG. 17C, the electric motor 30 is connected to the battery 54 through a power supply wire 56. The power supply wire 56 extends from inside to outside the hull 2 through a first through-hole 57 provided in the hull 2. A first cylindrical seal 58 provides a tight seal between the inner peripheral surface of the first through-hole 57 and the power supply wire 56. The second propulsion unit 405C includes a switch 477 connected to the power supply wire 56. The second propulsion unit 405C may further include a transformer connected to the power supply wire 56. The switch 477 is arranged to be operated by the vessel operator. The switch 477 is also arranged to open and close an electrical circuit connecting the electric motor 30 and the battery 54.

Fifth Preferred Embodiment

Next, a fifth preferred embodiment of the present invention will be described.

The fifth preferred embodiment is different from the above-described first preferred embodiment mainly in that the second propulsion units are provided with a decelerator that transmits the rotation from the electric motor to the second drive shaft in a decelerated manner.

Figure 18:
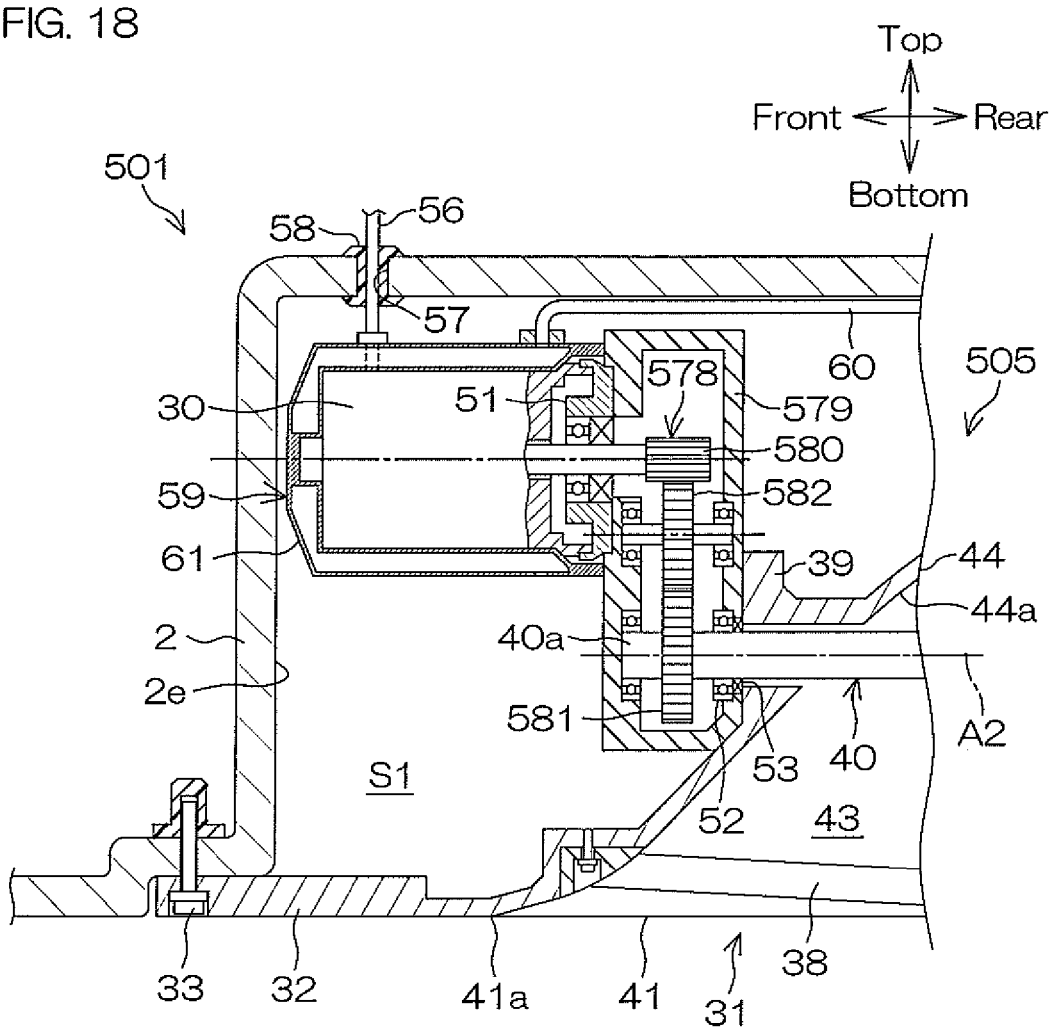
FIG. 18 is a partial sectional view of a second propulsion unit according to a fifth preferred embodiment of the present invention.

FIG. 18 is a partial sectional view of a second propulsion unit 505 according to the fifth preferred embodiment of the present invention. In FIG. 18, components corresponding to those shown in FIGS. 1 to 17C are designated by the same reference numerals as in FIG. 1, etc., to omit the description thereof.

The marine vessel 501 according to the fifth preferred embodiment preferably has a structure similar to that of the marine vessel 1 according to the first preferred embodiment. That is, the marine vessel 501 includes a second propulsion unit 505, instead of the second propulsion unit 5 according to the first preferred embodiment. The second propulsion unit 505 includes a decelerator 578 that transmits the rotation of the electric motor 30 to the second drive shaft 40 and a gear housing 579 covering the decelerator 578, in addition to the configuration of the second propulsion unit 5 according to the first preferred embodiment. The decelerator 578 may be a gear-based transmission device including multiple gears or a belt-based transmission device including an endless belt and multiple pulleys. FIG. 18 shows the case where the decelerator 578 is a gear-based transmission device.

The decelerator 578 shown in FIG. 18 includes a driving gear 580 coupled to the output shaft 30*a* of the electric motor 30 and a driven gear 581 coupled to the second drive shaft 40. The driving gear 580 and the driven gear 581 may be engaged with each other or may be engaged with an intermediate gear 582 (idle gear) that transmits rotation between the driving gear 580 and the driven gear 581. The driving gear 580, the driven gear 581, and the intermediate gear 582 are arranged in the gear housing 579. The electric motor 30 is attached to the motor attachment portion 39 via the gear housing 579.

The output shaft 30*a* of the electric motor 30 is arranged parallel or substantially parallel with the second drive shaft 40. The output shaft 30*a* of the electric motor 30 may be disposed above or below the second drive shaft 40, or may be disposed right or left to the second drive shaft 40. The rotation of the electric motor 30 is decelerated by the decelerator 578 and transmitted to the second drive shaft 40. Accordingly, the output torque of the electric motor 30 is transmitted to the second drive shaft 40 in an amplified manner. This can increase the maximum output of the second propulsion unit 505.

Sixth Preferred Embodiment

Next, a sixth preferred embodiment of the present invention will be described.

The sixth preferred embodiment is different from the above-described first preferred embodiment mainly in that the marine vessel is of not a hybrid type but an electric type.

Figure 19A:
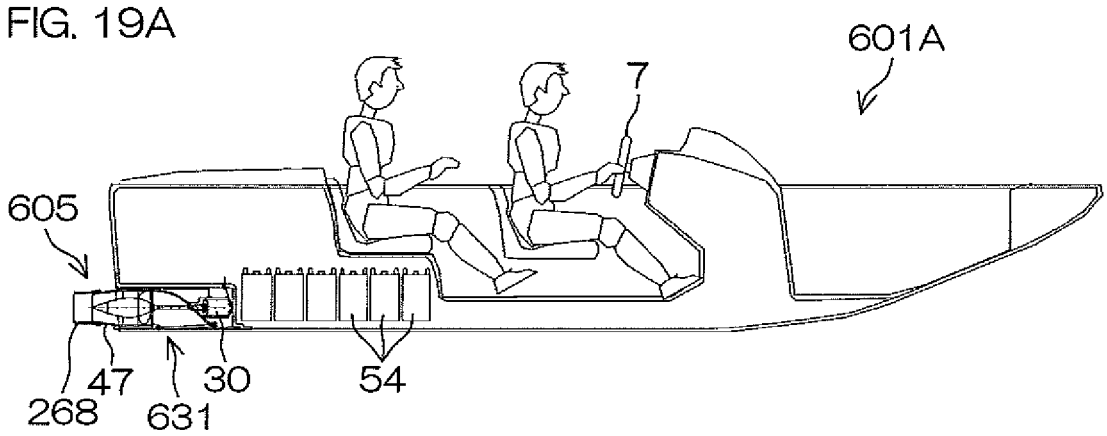
FIG. 19A is a schematic side view of a marine vessel according to a sixth preferred embodiment of the present invention.
Figure 19B:
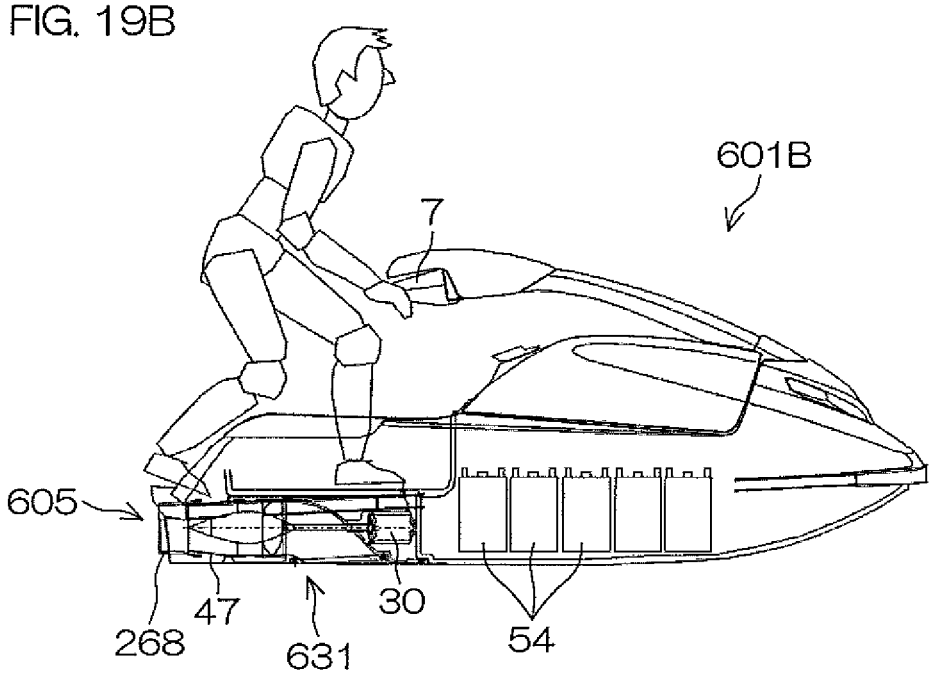
FIG. 19B is a schematic side view of a marine vessel according to the sixth preferred embodiment of the present invention.
Figure 19C:
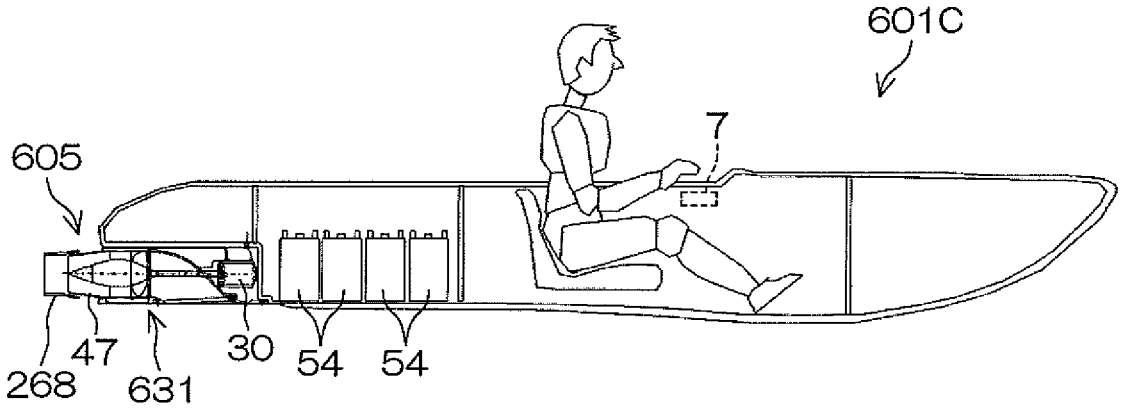
FIG. 19C is a schematic side view of a marine vessel according to the sixth preferred embodiment of the present invention.

FIGS. 19A, 19B, and 19C are schematic side views of marine vessels 601A, 601B, and 601C according to the sixth preferred embodiment of the present invention. In FIGS. 19A to 19C, components corresponding to those shown in FIGS. 1 to 18 are designated by the same reference numerals as in FIG. 1, etc., to omit the description thereof.

In the first preferred embodiment, the marine vessel is a boat including a first propulsion unit that uses an engine as a power source and a second propulsion unit that uses an electric motor as a power source. However, the marine vessel may include only a propulsion unit that uses an electric motor as a power source and not include a propulsion unit that uses an engine as a power source as shown in FIGS. 19A, 19B, and 19C. In addition, the marine vessel may be a PWC (Personal Watercraft), a kayak, or another type other than boats, PWCs, and kayaks.

Specifically, the marine vessel 601A shown in FIG. 19A is an electric boat that uses an electric motor 30 as a power source. The marine vessel 601B shown in FIG. 19B is an electric PWC that uses an electric motor 30 as a power source. The PWC may be a stand-up one as shown in FIG. 19B or include a saddle seat. The marine vessel 601C shown in FIG. 19C is an electric kayak that uses an electric motor 30 as a power source.

All of the marine vessels 601A, 601B, and 601C include an output control lever to be operated by the vessel operator for thrust force control, though not shown. The marine vessels 601A, 601B, and 601C also include a steering mechanism 7 to be operated by the vessel operator to steer the marine vessels 601A, 601B, and 601C. The steering mechanism 7 in the marine vessel 601C shown in FIG. 19C is preferably a lever or handle bar laterally extending in the hull 2.

As shown in FIGS. 19A, 19B, and 19C, the marine vessels 601A, 601B, and 601C include a second propulsion unit 605 and a battery 54 thus supplies power to the second propulsion unit 605. The second propulsion unit 605 preferably has a structure similar to that of the second propulsion unit 5 according to the first preferred embodiment. That is, the second propulsion unit 605 includes a second jet pump 631, instead of the second jet pump 31 according to the first preferred embodiment. The second jet pump 631 includes a second deflector 268 that changes the direction of jet flow from the second nozzle 47, in addition to the configuration of the second jet pump 31 according to the first preferred embodiment. The second deflector 268 is arranged to rotate laterally about the deflector rotational axis Ad2 (see FIG. 15) in conjunction with the operation of the steering mechanism 7 by the vessel operator. This causes the direction of jet flow to be changed, so that the marine vessels 601A, 601B, and 601C are steered.

Other Preferred Embodiments

Though the present invention has been described with respect to the first to sixth preferred embodiments above, it is not restricted thereto, and various changes may be made without departing from the scope of the present invention as defined in the following claims.

For example, in the first preferred embodiment, the two first propulsion units and two second propulsion units are provided and the pair of second propulsion units are arranged on the outer side of the pair of first propulsion units in the width direction of the hull (see FIG. 3). However, the number of the first propulsion units is not limited to two, but may be one or three or more. The same applies to the second propulsion units. Further, the first and second propulsion units may be arranged, respectively, in accordance with the number thereof. For example, the second propulsion units may not be arranged on the outer side of the first propulsion units (farther from the hull center), but may be arranged on the inner side of the first propulsion units.

In the first preferred embodiment, the bottom portion of the hull has a laterally symmetrical V shape from a rear view. However, the bottom portion of the hull may not be laterally symmetrical. Further, the bottom portion of the hull may not have a V shape in a rear view. Specifically, the bottom portion of the hull may have, for example, a laterally symmetrical U shape or a flat shape in a rear view.

In the first preferred embodiment, each of the first propulsion units (engine propulsion units) is a jet propulsion unit including a jet pump. However, the first propulsion unit may be a propeller propulsion unit including a propeller. In this case, the propeller propulsion unit may be an inboard motor including a power source (engine) and a drive unit that transmits power from the power source to the propeller disposed in the hull. Alternatively, the propeller propulsion unit may be an outboard motor including a power source and a drive unit both disposed outside the hull or may be an inboard/outboard motor including a power source disposed in the hull and a power source disposed outside the hull.

In the second preferred embodiment, each of the second propulsion units includes a second deflector 268 and a second bucket 269 (see FIG. 15). However, the second propulsion unit may include only one of either the second deflector or the second bucket.

The present application corresponds to Japanese Patent Application No. 2011-256432 filed in the Japan Patent Office on Nov. 24, 2011, and the entire disclosure of the application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel comprising:

a hull;

a jet pump disposed outside the hull and including a water inlet, a jet nozzle disposed rearward of the water inlet, and a flow path connecting the water inlet and the jet nozzle, the jet pump being arranged to jet water, taken in through the water inlet, through the jet nozzle; and an electric motor disposed outside of the flow path, outside of the hull, and between the hull and the jet pump and arranged to drive the jet pump.

2. The marine vessel according to claim 1, wherein the jet pump includes a motor attachment portion to which the electric motor is attached.

3. The marine vessel according to claim 2, wherein the jet pump includes a duct defining at least a portion of the flow path, and the motor attachment portion is disposed forward of the duct.

4. The marine vessel according to claim 3, wherein the motor attachment portion is integral with the duct.

5. The marine vessel according to claim 2, wherein the motor attachment portion is disposed rearward of a front end of the water inlet.

6. The marine vessel according to claim 2, wherein the jet pump and the electric motor are unitized so as to be installed to the hull with the electric motor being attached to the motor attachment portion.

7. The marine vessel according to claim 2, wherein the electric motor is attached to the motor attachment portion via a spacer.

8. The marine vessel according to claim 1, further comprising:

a cooling water pipe extending from the flow path to the electric motor outside the hull; and a motor cooling device that cools the electric motor with water supplied from the flow path into the cooling water pipe.

9. The marine vessel according to claim 8, wherein the motor cooling device is attached to the electric motor and further includes a water jacket connected to the cooling water pipe.

10. The marine vessel according to claim 8, wherein the cooling water pipe further includes a discharge portion that discharges water supplied from the flow path into the cooling water pipe toward the electric motor.

11. The marine vessel according to claim 1, further comprising:

a motor controller disposed in the hull and programmed to control the electric motor;

a battery disposed in the hull and arranged to supply power to the motor controller;

a power supply wire extending from inside to outside the hull through a first through-hole provided in the hull and connecting the motor controller and the electric motor; and a first seal between the inner peripheral surface of the first through-hole and the power supply wire.

12. The marine vessel according to claim 1, further comprising:

a battery disposed in the hull;

an operation unit disposed in the hull and arranged to be operated by a vessel operator;

a motor controller located in the electric motor and programmed to control the electric motor;

a power supply wire extending from inside to outside the hull through a first through-hole provided in the hull and connecting the motor controller and the battery;

a control wire extending from inside to outside the hull through a second through-hole provided in the hull and connecting the operation unit and the motor controller, through which a control signal is transmitted between the operation unit and the motor controller;

a first seal between an inner peripheral surface of the first through-hole and the power supply wire; and a second seal between an inner peripheral surface of the second through-hole and the control wire.

13. The marine vessel according to claim 1, further comprising:

a battery disposed in the hull;

an operation unit disposed in the hull and arranged to be operated by a vessel operator;

a motor controller located in the electric motor and programmed to control the electric motor;

a power supply wire extending from inside to outside the hull through a common through-hole provided in the hull and connecting the motor controller and the battery;

a control wire extending from inside to outside the hull through the common through-hole and connecting the operation unit and the motor controller, through which a control signal is transmitted between the operation unit and the motor controller; and a common seal between an inner peripheral surface of the common through-hole and the power supply wire and between an inner peripheral surface of the common through-hole and the control wire.

14. The marine vessel according to claim 1, further comprising:

a battery disposed in the hull;

a power supply wire extending from inside to outside the hull through a first through-hole provided in the hull and connecting the battery and the electric motor; and a first seal between an inner peripheral surface of the first through-hole and the power supply wire.

15. A marine vessel propulsion unit comprising:

a jet pump including a water inlet, a jet nozzle disposed rearward of the water inlet, and a flow path connecting the water inlet and the jet nozzle and including an impeller disposed in the flow path, the jet pump being arranged to jet water, taken in through the water inlet, through the jet nozzle;

an electric motor disposed outside the flow path and attached to the jet pump, the electric motor being arranged to rotationally drive the impeller; and a drive shaft that transmits a rotation of the electric motor to the impeller, the drive shaft including a front end portion arranged to rotate together with an output shaft of the electric motor, and a rear end portion arranged to rotate together with the impeller.

16. The marine vessel propulsion unit according to claim 15, wherein the jet pump includes a duct defining at least a portion of the flow path upstream from the impeller and a motor attachment portion disposed rearward of the duct; and the electric motor is attached to the motor attachment portion.

17. The marine vessel propulsion unit according to claim 16, wherein the motor attachment portion is disposed rearward of a front end of the water inlet.

18. The marine vessel propulsion unit according to claim 16, wherein the motor attachment portion is integral with the duct.

19. The marine vessel propulsion unit according to claim 15, wherein the jet pump and the electric motor are unitized so as to be installed to the hull with the electric motor being attached to the jet pump.

20. The marine vessel propulsion unit according to claim 15, further comprising:

a cooling water pipe extending from the flow path to the electric motor; and a motor cooling device that cools the electric motor with water supplied from the flow path into the cooling water pipe.

21. The marine vessel propulsion unit according to claim 20, wherein the cooling water pipe extends from a portion of the flow path downstream from the impeller to the electric motor.

22. The marine vessel propulsion unit according to claim 20, wherein the motor cooling device is attached to the electric motor and includes a water jacket connected to the cooling water pipe.

23. The marine vessel propulsion unit according to claim 20, wherein the cooling water pipe includes a discharge portion that discharges water supplied from the flow path into the cooling water pipe toward the electric motor.

24. The marine vessel propulsion unit according to claim 15, wherein the drive shaft includes an intermediate portion not in contact with the jet pump.

25. The marine vessel propulsion unit according to claim 15, wherein the electric motor is rotatable in a forward direction and in a reverse direction;

the rotation of the electric motor in the forward direction causes the impeller to rotate in a forward direction and thereby take water through the water inlet into the flow path to be jetted through the jet nozzle, resulting in a thrust force in a first direction; and the rotation of the electric motor in the reverse direction causes the impeller to rotate in a reverse direction and thereby take water through the jet nozzle into the flow path to be jetted through the water inlet, resulting in a thrust force in a second direction opposite to the first direction.

* * * * *